US007130555B2

(12) United States Patent
Kishi et al.

(10) Patent No.: US 7,130,555 B2
(45) Date of Patent: Oct. 31, 2006

(54) FIXING UNIT HAVING A PLURALITY OF HEATERS, IMAGE FORMING APPARATUS AND METHOD OF DETERMINING TEMPERATURE DETECTING POSITION OF TEMPERATURE SENSOR

(75) Inventors: Kazuhito Kishi, Kanagawa (JP); Yasuhisa Kato, Kanagawa (JP); Akiyasu Amita, Kanagawa (JP); Masami Okamoto, Kanagawa (JP); Yasutada Tsukioka, Chiba (JP); Hiromasa Takagi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 226 days.

(21) Appl. No.: 10/814,161

(22) Filed: Apr. 1, 2004

(65) Prior Publication Data

US 2004/0258426 A1 Dec. 23, 2004

(30) Foreign Application Priority Data

Apr. 1, 2003 (JP) ..... 2003-098055

(51) Int. Cl.
*G03G 15/20* (2006.01)

(52) U.S. Cl. ..... 399/69; 399/70; 399/88; 399/330; 399/334

(58) Field of Classification Search ..... 399/69, 399/70, 88, 90, 328, 330, 334
See application file for complete search history.

(56) References Cited

U.S. PATENT DOCUMENTS

| | | | | |
|---|---|---|---|---|
| 4,843,214 | A | 6/1989 | Higashi et al. | |
| 5,400,123 | A | 3/1995 | Sato et al. | |
| 5,481,350 | A | 1/1996 | Yasui et al. | |
| 5,729,798 | A | 3/1998 | Yasui et al. | |
| 5,745,247 | A | 4/1998 | Yasui et al. | |
| 5,839,032 | A | 11/1998 | Yasui et al. | |
| 5,854,465 | A | 12/1998 | Kishi et al. | |
| 6,112,047 | A | 8/2000 | Kato et al. | |
| 6,134,418 | A | 10/2000 | Kato et al. | |
| 6,144,832 | A | 11/2000 | Nimura et al. | |
| 6,239,864 | B1 | 5/2001 | Okamoto | |
| 6,263,185 | B1 | 7/2001 | Kato et al. | |
| 6,394,446 | B1 | 5/2002 | Okamoto | |
| 6,411,795 | B1 | 6/2002 | Okamoto | |
| 6,542,705 | B1 | 4/2003 | Fujita et al. | 399/69 |
| 6,941,088 | B1 * | 9/2005 | Atsushi et al. | 399/69 |

(Continued)

FOREIGN PATENT DOCUMENTS

JP 2002-174988 6/2002

OTHER PUBLICATIONS

U.S. Appl. No. 11/283,828, filed Nov. 22, 2005, Okamoto.

(Continued)

*Primary Examiner*—William J. Royer
(74) *Attorney, Agent, or Firm*—Oblon, Spivak, McClelland, Maier & Neustadt, P.C.

(57) ABSTRACT

A fixing unit thermally fixes a toner on a recording medium by a fixing member having a plurality of internal heaters and an outer peripheral surface, and a temperature sensor detects a surface temperature of the fixing member at a temperature detecting position. At least one first heater, of the heaters, receives power from a first power supply, and remaining second heaters receive power from a second power supply. One of the second heaters closest to the temperature detecting position is the same distance from the temperature detecting position as or is closer to the temperature detecting position than a first heater which is closest to the temperature detecting position.

36 Claims, 14 Drawing Sheets

U.S. PATENT DOCUMENTS 6,987,936 B1 * 1/2006 Satoh et al. ..... 399/88

OTHER PUBLICATIONS

U.S. Appl. No. 07/592,522, filed Oct. 4, 1990, unknown.
U.S. Appl. No. 08/487,641, filed Jun. 7, 1995, unknown.
U.S. Appl. No. 09/409,587, filed Sep. 30, 1999, Kato et al.
U.S. Appl. No. 10/375,031, filed Feb. 28, 2003, Amita et al.
U.S. Appl. No. 10/448,356, filed May 30, 2003, Yura et al.
U.S. Appl. No. 11/004,928, filed Dec. 7, 2004, Kishi et al.
U.S. Appl. No. 11/208,758, filed Aug. 23, 2005, Kishi et al.
U.S. Appl. No. 11/220,582, filed Sep. 8, 2005, Matsusaka et al.
U.S. Appl. No. 11/208,753, filed Aug. 23, 2005, Kishi et al.
U.S. Appl. No. 11/220,621, filed Sep. 8, 2005, Kishi et al.
U.S. Appl. No. 11/220,686, filed Sep. 8, 2005, Matsusaka et al.
U.S. Appl. No. 11/221,838, filed Sep. 9, 2005, Kishi et al.
U.S. Appl. No. 11/405,448, filed Apr. 18, 2006, Kishi et al.

* cited by examiner

FIXING UNIT HAVING A PLURALITY OF HEATERS, IMAGE FORMING APPARATUS AND METHOD OF DETERMINING TEMPERATURE DETECTING POSITION OF TEMPERATURE SENSOR

BACKGROUND OF THE INVENTION

This application claims the benefit of a Japanese Patent Application No.2003-098055 filed Apr. 1, 2003, in the Japanese Patent Office, the disclosure of which is hereby incorporated by reference.

1. Field of the Invention

The present invention generally relates to fixing units and image forming apparatuses, and more particularly to a fixing unit having a battery for supplying power to a heater, an image forming apparatus having such a fixing unit, and a method of determining a temperature detecting position of a temperature sensor.

2. Description of the Related Art

Generally, electrophotography type image forming apparatuses such as copying apparatuses, printers, facsimile apparatuses and composite apparatuses, form a toner image on a recording medium such as recording paper or sheet, and heat the toner image by passing the recording medium through a fixing unit so to fix the toner image on the recording medium.

In the fixing unit, power is supplied to a heater so that the heater heats a fixing member such as a roller and an endless belt. The toner image on the recording medium is heated when the fixing member, such as the roller and the endless belt, contacts the recording medium. Conventionally, the power to the heater is supplied from a commercial A.C. power supply. However, a Japanese Laid-Open Patent Application No.2002-174988 proposes a fixing unit which is designed so that the power to the heaters of the fixing unit is also supplied using a battery.

In other words, in a case where the fixing unit is started from a stopped state by turning ON a main power supply, for example, it takes time for the fixing unit to reach a usable state, and the fixing unit cannot be used for a waiting time until the usable state is reached. In order to reduce this waiting time, the Japanese Laid-Open Patent Application No.2002-174988 supplies power to the heaters of the proposed fixing unit by using both the commercial A.C. power supply and the battery, so as to rapidly heat the fixing member to a reload temperature.

But when starting this proposed fixing unit, even if the power supply to the heaters is controlled based on a temperature of the proposed fixing unit that is detected by a temperature sensor, the fixing member may actually be heated to a temperature which exceeds a set temperature. It is undesirable, however, for the temperature of the fixing member to exceed the set temperature.

SUMMARY OF THE INVENTION

Accordingly, it is a general object of the present invention to provide a novel and useful fixing unit, image forming apparatus and a method of determining a temperature detecting position of a temperature sensor, in which the problems described above are suppressed.

Another and more specific object of the present invention is to provide a fixing unit and an image forming apparatus, in which a fixing member is heated within a range less than or equal to a set temperature when at least one heater is designed to receive power from a battery, so as to more positively ensure safety.

Another more specific object of the present invention is to provide a method of determining a temperature detecting position of a temperature sensor which detects a surface temperature of a fixing member of a fixing unit.

Still another and more specific object of the present invention is to provide a fixing unit to thermally fix a toner on a recording medium, comprising a fixing member having a plurality of internal heaters, and an outer peripheral surface configured to fix the toner on the recording medium; and a temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, having a state which generates no heat in response to power supplied from a first power supply even during an operation of the fixing unit, remaining second heaters, of the plurality of heaters, being capable of constantly generating heat in response to power supplied from a second power supply during the operation of the fixing unit, one of the second heaters closest to the temperature detecting position is the same distance from the temperature detecting position as or is closer to the temperature detecting position than a first heater which is closest to the temperature detecting position. According to the fixing unit of the present invention, the first heater closest to the temperature detecting position will not block the heat generated from one or more second heaters, and the surface temperature of the fixing member at the temperature detecting position may be made substantially the same as the surface temperature at other surface positions of the fixing member. For this reason, it is possible to safely heat the fixing member within a range less than or equal to a set temperature.

A further object of the present invention is to provide a fixing unit to thermally fix a toner on a recording medium, comprising a fixing member having a plurality of internal heaters, and an outer peripheral surface configured to fix the toner on the recording medium; and a temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, receiving power from a first power supply, remaining second heaters, of the plurality of heaters, receiving power from a second power supply which is different from the first power supply, one of the second heaters closest to the temperature detecting position is the same distance from the temperature detecting position as or is closer to the temperature detecting position than a first heater which is closest to the temperature detecting position. According to the fixing unit of the present invention, the first heater closest to the temperature detecting position will not block the heat generated from one or more second heaters, and the surface temperature of the fixing member at the temperature detecting position may be made substantially the same as the surface temperature at other surface positions of the fixing member. For this reason, it is possible to safely heat the fixing member within a range less than or equal to a set temperature.

Another object of the present invention is to provide an image forming apparatus adapted to form an image on a recording medium by an electrophotography technique, comprising an image forming unit configured to form a toner image on a recording medium; and a fixing unit configured to thermally fix the toner image on the recording medium, the fixing unit comprising a fixing member having a plurality of internal heaters, and an outer peripheral surface configured to fix the toner on the recording medium; and a temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, having a state which generates no heat in response to power supplied from a first power supply even during an operation of the fixing unit, remaining second heaters, of the plurality of heaters, being capable of constantly generating heat in response to power supplied from a second power supply during the operation of the fixing unit, one of the second heaters closest to the temperature detecting position is the same distance from the temperature detecting position as or is closer to the temperature detecting position than a first heater which is closest to the temperature detecting position. According to the image forming apparatus of the present invention, the first heater closest to the temperature detecting position will not block the heat generated from one or more second heaters, and the surface temperature of the fixing member at the temperature detecting position may be made substantially the same as the surface temperature at other surface positions of the fixing member. For this reason, it is possible to safely heat the fixing member within a range less than or equal to a set temperature, and a satisfactory image can be formed on the recording medium.

Still another object of the present invention is to provide an image forming apparatus adapted to form an image on a recording medium by an electrophotography technique, comprising an image forming unit configured to form a toner image on a recording medium; and a fixing unit configured to thermally fix the toner image on the recording medium, the fixing unit comprising a fixing member having a plurality of internal heaters, and an outer peripheral surface configured to fix the toner on the recording medium; and a temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, receiving power from a first power supply, remaining second heaters, of the plurality of heaters, receiving power from a second power supply which is different from the first power supply, one of the second heaters closest to the temperature detecting position is the same distance from the temperature detecting position as or is closer to the temperature detecting position than a first heater which is closest to the temperature detecting position. According to the image forming apparatus of the present invention, the first heater closest to the temperature detecting position will not block the heat generated from one or more second heaters, and the surface temperature of the fixing member at the temperature detecting position may be made substantially the same as the surface temperature at other surface positions of the fixing member. For this reason, it is possible to safely heat the fixing member within a range less than or equal to a set temperature, and a satisfactory image can be formed on the recording medium.

A further object of the present invention is to provide a fixing unit to thermally fix a toner on a recording medium, comprising a fixing member having a plurality of internal heaters, and an outer peripheral surface configured to fix the toner on the recording medium; and at least one temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, being capable of receiving power from a battery, remaining second heaters, of the plurality of heaters, being capable of receiving power from an external power supply, a temperature distribution of the surface temperature when the first heater is ON and a temperature distribution of the surface temperature when the first heater is OFF having a difference smaller than a predetermined value at the temperature detecting position. According to the fixing unit of the present invention, it is possible to safely and accurately control the surface temperature of the fixing member.

Still another object of the present invention is to provide a fixing unit to thermally fix a toner on a recording medium, comprising a fixing member having a plurality of internal heaters, and an outer peripheral surface configured to fix the toner on the recording medium; and at least one temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, being capable of receiving power from a battery, remaining second heaters, of the plurality of heaters, being capable of receiving power from an external power supply, a temperature distribution of the surface temperature when no first heater is provided and at least one of the second heaters is turned ON and a temperature distribution of the surface temperature when the first heater is provided and at least one of the second heaters is turned ON having a difference smaller than a predetermined value at the temperature detecting position. According to the fixing unit of the present invention, it is possible to safely and accurately control the surface temperature of the fixing member.

Still another object of the present invention is to provide an image forming apparatus adapted to form an image on a recording medium by an electrophotography technique, comprising an image forming unit configured to form a toner image on a recording medium; and a fixing unit configured to thermally fix the toner image on the recording medium, the fixing unit comprising a fixing member having a plurality of internal heaters, and an outer peripheral surface configured to fix the toner on the recording medium; and at least one temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, being capable of receiving power from a battery, remaining second heaters, of the plurality of heaters, being capable of receiving power from an external power supply, a temperature distribution of the surface temperature when the first heater is ON and a temperature distribution of the surface temperature when the first heater is OFF having a difference smaller than a predetermined value at the temperature detecting position. According to the image forming apparatus of the present invention, it is possible to safely and accurately control the surface temperature of the fixing member, and stably fix the toner image on the recording medium.

A further object of the present invention is to provide an image forming apparatus adapted to form an image on a recording medium by an electrophotography technique, comprising an image forming unit configured to form a toner image on a recording medium; and a fixing unit configured to thermally fix the toner image on the recording medium, the fixing unit comprising a fixing member having a plurality of internal heaters, and an outer peripheral surface configured to fix the toner on the recording medium; and at least one temperature sensor configured to detect a surface temperature of the fixing member at a temperature detecting position, the plurality of heaters receiving power based on the surface temperature detected by the temperature sensor so that the surface temperature becomes a predetermined temperature, at least one first heater, of the plurality of heaters, being capable of receiving power from a battery, remaining second heaters, of the plurality of heaters, being capable of receiving power from an external power supply, a temperature distribution of the surface temperature when no first heater is provided and at least one of the second heaters is turned ON and a temperature distribution of the surface temperature when the first heater is provided and at least one of the second heaters is turned ON having a difference smaller than a predetermined value at the temperature detecting position. According to the image forming apparatus of the present invention, it is possible to safely and accurately control the surface temperature of the fixing member, and stably fix the toner image on the recording medium.

Another object of the present invention is to provide a method of determining a temperature detecting position of a temperature sensor which is configured to detect a surface temperature of a fixing member having a plurality of internal heaters which receive power based on the surface temperature detected by the temperature sensor, at least one first heater, of the plurality of heaters, being capable of receiving power from a battery, remaining second heaters, of the plurality of heaters, being capable of receiving power from an external power supply, the method comprising the steps of obtaining a first temperature distribution of the surface temperature when the first heater and at least one second heater is ON; obtaining a second temperature distribution of the surface temperature when the first heater is OFF and the at least one second heater is ON; and determining the temperature detecting position of the temperature sensor to a location where a difference between the first and second temperature distributions is smaller than a predetermined value. In this case, it is possible to determine the temperature detecting position of the temperature sensor which ensures safe and accurate control of the surface temperature of the fixing member.

Still another object of the present invention is to provide a method of determining a temperature detecting position of a temperature sensor which is configured to detect a surface temperature of a fixing member having a plurality of internal heaters which receive power based on the surface temperature detected by the temperature sensor, at least one first heater, of the plurality of heaters, being capable of receiving power from a battery, remaining second heaters, of the plurality of heaters, being capable of receiving power from an external power supply, the method comprising the steps of obtaining a first temperature distribution of the surface temperature when no first heater is provided and at least one second heater is ON; obtaining a second temperature distribution of the surface temperature when the first heater is provided and at least one second heater is ON; and determining the temperature detecting position of the temperature sensor to a location where a difference between the first and second temperature distributions is smaller than a predetermined value. In this case, it is possible to determine the temperature detecting position of the temperature sensor which ensures safe and accurate control of the surface temperature of the fixing member.

Other objects and further features of the present invention will be apparent from the following detailed description when read in conjunction with the accompanying drawings.

DESCRIPTION OF THE PREFERRED EMBODIMENTS

First, a description will be given of a basic structure of a fixing unit to which the present invention may be applied, by referring to FIGS. 1 through 4.

Figure 1:
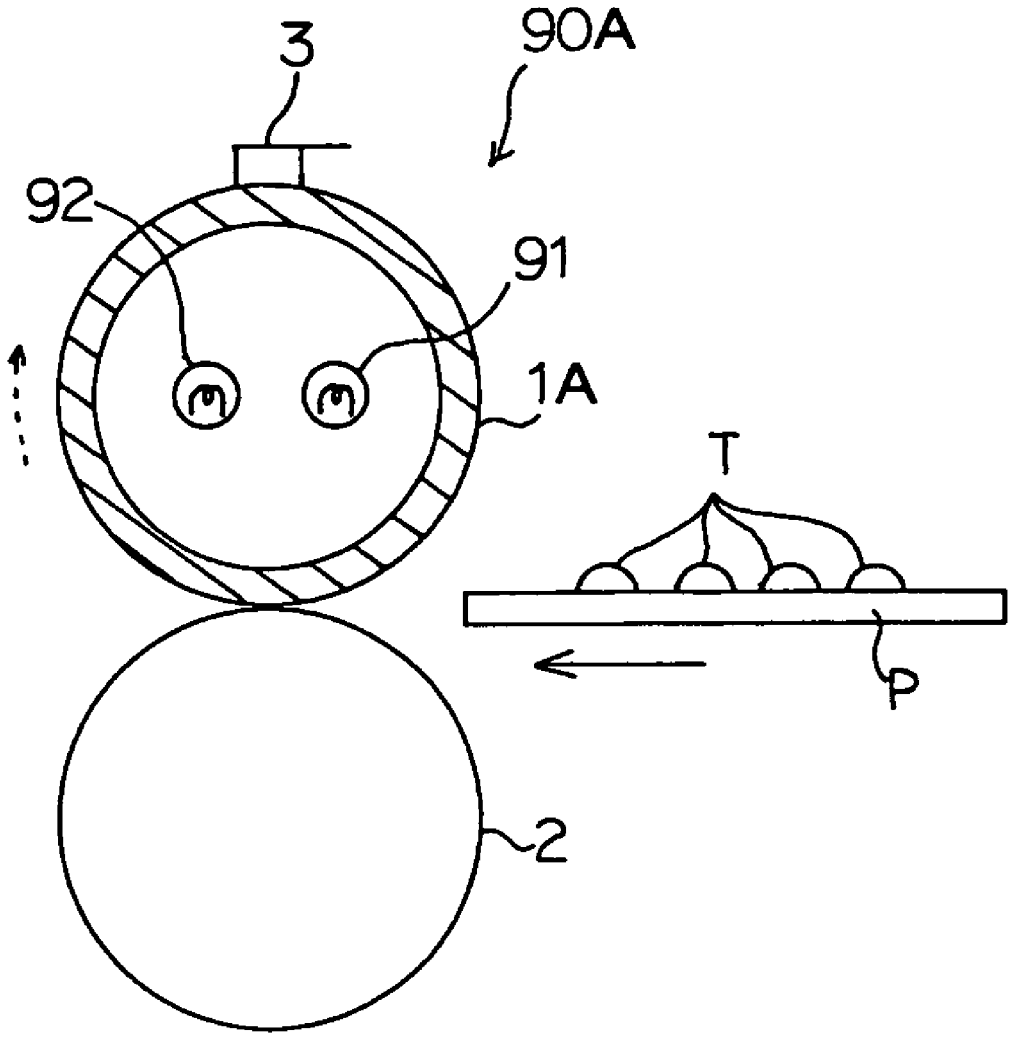
FIG. 1 is a cross sectional view showing a part of a fixing unit.

FIG. 1 is a cross sectional view showing a part of a fixing unit. A fixing unit 90A shown in FIG. 1 includes a fixing roller 1A which forms a fixing member, and a pressure roller 2 which presses against the fixing roller 1A at a predetermined nip pressure by an operation of a known pressing means (not shown). The fixing roller 1A is rotated clockwise by a known driving mechanism (not shown), and the pressure roller 2 rotates counterclockwise. The fixing roller 1A includes heaters 91 and 92 which generate heat in response to power supplied thereto. An outer peripheral surface of the fixing roller 1A is heated to a reload temperature capable of fixing a toner T, that is, a toner image, by the heat generated from the heaters 91 and 92. The surface temperature of the fixing roller 1A is monitored by a known temperature detecting means such as a temperature sensor 3 which detects the temperature by contacting the outer peripheral surface of the fixing roller 1A.

When carrying out an image forming process in an image forming apparatus, a recording medium P, such as recording paper or sheet, which has the toner T (or toner image) formed thereon by an electrophotography technique, is passed through a nip part between the fixing roller 1A and the pressure roller 2. The recording medium P is thus heated by the fixing roller 1A and the pressure roller 2, and the toner T (or toner image) is fixed on the recording medium P. A predetermined amount of heat is required in order to fix the toner T on the recording medium P, and the supply of power to the heaters 91 and 92 is controlled so that the surface temperature of the fixing roller 2 becomes the reload temperature.

Figure 2:
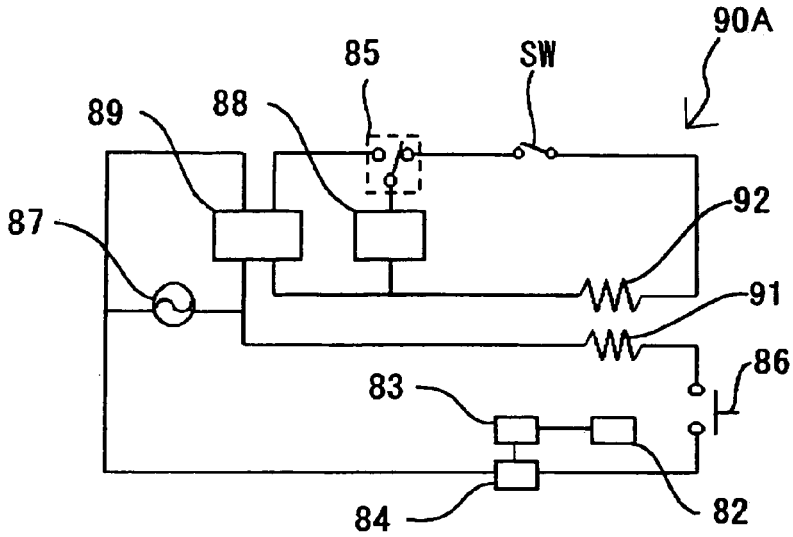
FIG. 2 is a circuit diagram showing a circuit structure of the fixing unit.

FIG. 2 is a circuit diagram showing a circuit structure of the fixing unit 90A. In FIG. 2, the heater 91 generates heat in response to power supplied from an external power supply (commercial A.C. power supply) 87, and the heater 92 generates heat in response to power supplied from a capacitor 88 which forms a battery. A temperature detection signal from the temperature sensor 3, which detects the surface temperature of the fixing roller 1A, is supplied to a CPU 83 via an input circuit 82. The CPU 83 controls the supply of power to the heater 91 via a driver 84 and a thermostat 86, and supplies the supply of power to the heater 92 via a switch SW, based on the temperature detection signal, so that the surface temperature of the fixing roller 1A becomes a set temperature. The capacitor 88 may be connected to a charging unit 89 and charged, by controlling a switch 85.

The thermostat 86 is turned OFF when the temperature of the fixing unit 90A exceeds an upper limit temperature, so as to cut off the supply of power from the external power supply 87 to the heater 91.

In a case where the fixing unit 90A is started from a stopped state by turning ON a main power supply, for example, it is desirable to reduce a waiting time which is required until the fixing unit 90A reaches a usable state. Hence, the power is supplied to both the heaters 91 and 92 to rapidly heat the fixing roller 1A to the reload temperature. As a result, it is unnecessary to supply preheating power to the heaters 91 and 92 in the stopped state, the fixing roller 1A can be heated efficiently.

When starting the fixing unit 90A, the fixing roller 1A is not rotated, and the fixing roller 1A is heated based on the temperature detection signal from the temperature sensor 3 which detects the surface temperature of the stationary fixing roller 1A. In other words, when supplying power from the external power supply 87 to the heater 91, if the surface temperature of the fixing roller 1A detected by the temperature sensor 3 has not reached a predetermined temperature, the switch SW is turned ON to supply power from the capacitor 88 to the heater 92. In addition, when the surface temperature of the fixing roller 1A detected by the temperature sensor 3 reaches an upper limit value of the predetermined temperature, the switch SW is turned OFF to cut off the power supply from the capacitor 88 to the heater 92. Alternatively, the surface temperature of the fixing roller 1A after a predetermined time is predicted from the surface temperature of the fixing roller 1A and a temperature rising (or heating) gradient thereof, and the power supply from the capacitor 88 to the heater 92 is cut off so that the predicted surface temperature does not exceed the upper limit value of the predetermined temperature. At the same time, the supply of power from the external power supply 87 to the heater 91 is continued, but the amount of power supplied to the heater 91 is suppressed by the driver 84 to such an extent that the surface temperature of the fixing roller 1A can be maintained to the reload temperature. Accordingly, by controlling, that is, enabling or disabling the power supply from the capacitor 88 to the heater 92, the power supply from the external power supply 87 to the heater 91 can constantly be made without having to enable or disable the power supply. As a result, the fixing roller 1A can be heated efficiently, and the surface temperature of the fixing roller 1A is simultaneously prevented from rising to an excessively high temperature.

However, even if the power supply to the heaters is controlled based on the surface temperature of the fixing roller detected by the temperature sensor, the surface temperature may actually be heated to a temperature exceeding the set temperature depending on the arrangement of the heaters, as will be described hereunder in conjunction with FIG. 3.

Figure 3:
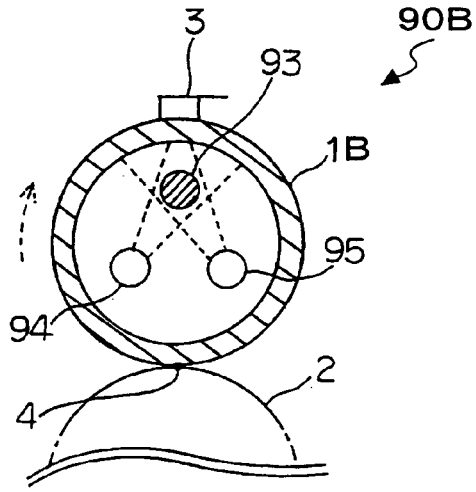
FIG. 3 is a cross sectional view showing a part of a fixing unit having three heaters.

FIG. 3 is a cross sectional view showing a part of a fixing unit having three heaters. In FIG. 3, those parts which are essentially the same as those corresponding parts in FIG. 1 are designated by the same reference numerals, and a description thereof will be omitted.

A fixing unit 90B shown in FIG. 3 includes a fixing roller 1B which has a hollow cylindrical shape and three heaters 93, 94 and 95 provided therein. The heater 93 generates heat in response to a D.C. current power supply from a battery such as a capacitor. On the other hand, the heaters 94 and 95 generate heat in response to an A.C. current power supply from an external power supply. A temperature sensor 3 detects the surface temperature of the fixing roller 1B, by contacting the outer peripheral surface of the fixing roller 1B at a diametrically opposite position from a nip part 4 relative to a center shaft (not shown) of the fixing roller 1B.

Although only the cross sectional shapes are shown in FIG. 3, the heaters 93, 94 and 95 have a rod shape, for example, and are disposed symmetrically about the center shaft of the fixing roller 1B at circumferential positions separated by a predetermined distance from an inner peripheral surface of the fixing roller 1B. In addition, the heater 93 is arranged at an upper portion within the fixing roller 1B, at a position directly below the temperature sensor 3. On the other hand, the heaters 94 and 95 are arranged at a lower portion within the fixing roller 1B. Similarly as described above in conjunction with FIG. 2, the power supply from the capacitor to the heater 93 is controlled, that is, enabled and disabled, while the power supply from the external power supply to the heaters 94 and 95 can constantly be made.

When starting the fixing unit 90B shown in FIG. 3, the fixing roller 1B is heated based on the surface temperature of the stationary fixing roller 1B detected by the temperature sensor 3. In this state, if the capacitor has been charged to such an extent that the capacitor is capable of supplying power, and since the surface temperature of the fixing roller 1B has not yet reached the predetermined temperature, the power from the capacitor is supplied to the heater 93 while power from the external power supply is supplied to the heaters 94 and 95, so as to rapidly heat the fixing roller 1B. Thus, the fixing roller 1B is heated uniformly in the circumferential direction thereof by the heaters 93, 94 and 95. For this reason, the surface temperature of the fixing roller 1B detected by the temperature sensor 3 and a nip temperature in the vicinity of the nip part 4 match, as indicated by a dotted line in FIG. 4.

Figure 4:
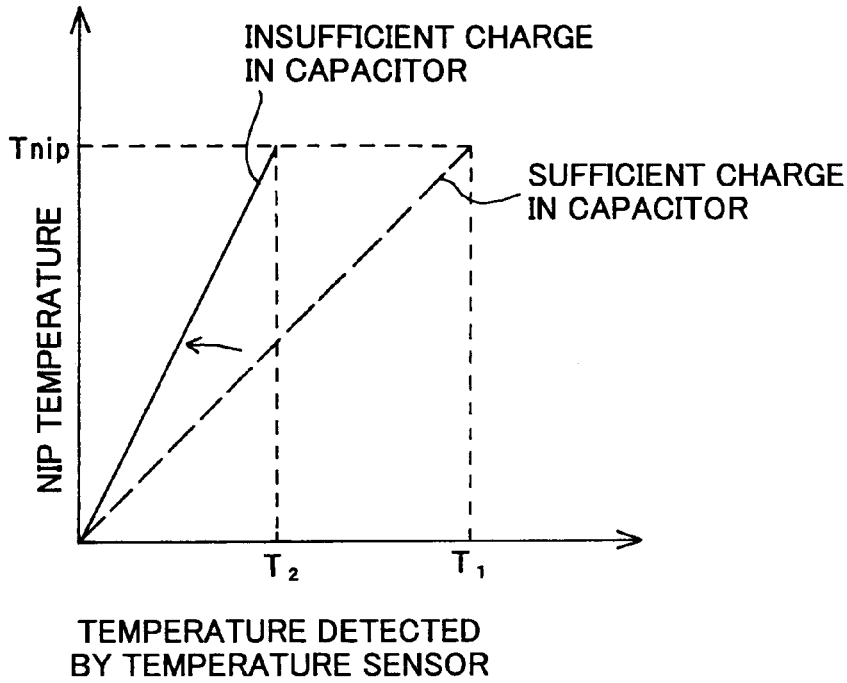
FIG. 4 is a diagram showing a relationship of a temperature detected by a temperature sensor and a nip temperature.

FIG. 4 is a diagram showing a relationship of the temperature detected by the temperature sensor 3 and the nip temperature in a vicinity of the nip part 4. In FIG. 4, the ordinate indicates the nip temperature in arbitrary units, and the abscissa indicates the temperature detected by the temperature sensor 3 in arbitrary units. When the temperature sensor 3 detects that the surface temperature of the fixing roller 1B has reached a reload temperature T1, the nip temperature in the vicinity of the nip part 4 has also reached a reload temperature Tnip (approximately equal to T1).

Thereafter, the power supply is controlled so that the surface temperature of the fixing roller 1B at the position detected by the temperature sensor 3 and the nip temperature in the vicinity of the nip part 4 are maintained to the reload temperature (T1, Tnip).

On the other hand, if the capacitor has only been charged to such an extent that the capacitor is not capable of supplying power due to insufficient charging, for example, no power is actually supplied from the capacitor to the heater 93 even though a circuit similar to that shown in FIG. 2 is provided to enable the power supply from the capacitor to the heater 93.

Consequently, the fixing roller 1B in this case is only heated by the heat generated from the heaters 94 and 95 which receive power from the external power supply.

The fixing roller 1B is heated from the inside by the heat radiated from the heaters 93, 94 and 95 within the fixing roller 1B. But in a state where no power is supplied from the capacitor to the heater 93 in FIG. 3, portions in the vicinity of the temperature detecting position of the temperature sensor 3 do not fully receive the heat radiated from the heaters 94 and 95 because the heat is blocked by the heater 93, and as a result, the nip temperature in the vicinity of the nip part 4 constantly becomes higher than the temperature detected by the temperature sensor 3 at the temperature detecting position. Accordingly, the surface temperature of the fixing roller 1B detected by the temperature sensor 3 does not match the nip temperature in the vicinity of the nip part 4, as indicated by a solid line in FIG. 4, and the nip temperature in the vicinity of the nip part 4 reaches the reload temperature Tnip (approximately equal to T1) before the surface temperature of the fixing roller 1B detected by the temperature sensor 3 reaches the reload temperature T1. More particularly, the surface temperature of the fixing roller 1B detected by the temperature sensor 3 is only T2 (<T1) when the nip temperature in the vicinity of the nip part 4 is Tnip (approximately equal to T1). Furthermore, since the surface temperature of the fixing roller 1B detected by the temperature sensor 3 has not yet reached the reload temperature T1, the power supply from the external power supply to the heaters 94 and 95 is continued so as to heat the fixing roller 1B, even after the nip temperature in the vicinity of the nip part 4 exceeds the reload temperature Tnip (approximately equal to T1). In this case, the excess heating is continued until the temperature sensor 3 detects that the surface temperature of the fixing roller 1B has reached the reload temperature T1, and in an extreme case, the nip temperature in the vicinity of the nip part 4 may reach an igniting temperature of the recording medium.

One particular case where the charge in the capacitor is insufficient, that is, the capacitor is not capable of supplying power, is when the capacitor is not charged due to the main power supply which is turned OFF immediately after the fixing unit is started, and the main power supply is turned ON afterwards to start the fixing unit.

Next, a description will be given of various embodiments of the fixing unit according to the present invention, an image forming apparatus according to the present invention, and a method of determining temperature detecting position of the temperature sensor, by referring to FIGS. 5 through 15.

Figure 5:
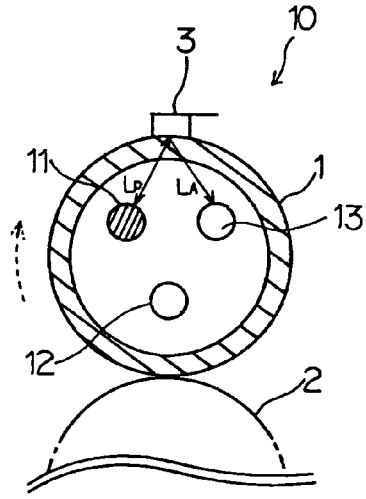
FIG. 5 is a cross sectional view showing a part of a first embodiment of a fixing unit according to the present invention.

FIG. 5 is a cross sectional view showing a part of a first embodiment of the fixing unit according to the present invention. In FIG. 5 and FIGS. 6 through 15 which will be described later, those parts which are essentially the same as those corresponding parts in FIG. 3 are designated by the same reference numerals, and a description thereof will be omitted.

A fixing unit 10 shown in FIG. 5 includes a fixing roller 1, a pressure roller 2 and a temperature sensor 3. The fixing roller 1 includes three heaters 11, 12 and 13 which heat the fixing roller 1 from the inside. The pressure roller 2 presses against the fixing roller 1 at a predetermined nip pressure. The temperature sensor 3 contacts an outer peripheral surface of the fixing roller 1 and outputs a temperature detection signal indicative of a surface temperature of the fixing roller 1 that is detected thereby.

In this embodiment, the fixing roller 1 has a hollow cylindrical shape. However, a fixing member is not limited to the fixing roller 1, and a fixing member having other forms, such as an endless belt, may be used in place of the fixing roller 1. The fixing roller 1 is stationary at the time of starting the fixing unit 10, and rotates clockwise in FIG. 5 when a recording medium (not shown) such as recording paper is passed through a nip part between the fixing roller 1 and the pressure roller 2.

The fixing unit 10 "at the time of starting" refers to a state where it is necessary to heat, that is, raise the temperature of the fixing roller 1, such as when the main power supply of the fixing unit 10 is turned ON and when the fixing unit 10 is restored to an operating state from a stopped or standby state.

In this embodiment, an outer peripheral surface of the pressure roller 2 is made of a sufficiently elastic material such as silicon rubber. However, a pressure member is not limited to the pressure roller 2, and a pressure member having other forms, such as an endless belt, may be used in place of the pressure roller 2. The pressure roller 2 presses against the fixing roller 1 at a predetermined nip pressure by an operation of a known pressure means (not shown). The pressing roller 2 is stationary at the time of starting the fixing unit 10, and rotates counterclockwise in FIG. 5 when the recording medium is passed through the nip part between the fixing roller 1 and the pressure roller 2. A known driving mechanism (not shown) drives and rotates the fixing roller 1 and the pressure roller 2. However, it is of course possible to drive and rotate only one of the fixing roller 1 and the pressure roller 2 by the driving mechanism.

The temperature sensor 3 is arranged at a temperature detecting position where the surface temperature of the fixing roller 1 is detected. This temperature detecting position is located at a diametrically opposite position from the nip part between the fixing roller 1 and the pressure roller 2, relative to a center shaft (not shown) of the fixing roller 1. The temperature sensor 3 may be formed by any temperature detecting means capable of detecting the surface temperature of the fixing roller 1, and the temperature detecting means does not need to make direct contact with the outer peripheral surface of the fixing roller 1 as long as it is possible to detect the surface temperature of the fixing roller 1. Hence, various contact type sensors and non-contact type sensors, including a radiation thermometer and a thermocouple (or thermoelectric) thermometer, may be used for the temperature sensor 3.

In this embodiment, each of the heaters 11, 12 and 13 has a rod shape, although only the cross section is shown in FIG. 5. The heater 11 receives power from a battery, such as a capacitor, and heats the fixing roller 1 by radiating heat towards the inner peripheral surface of the fixing roller 1. The power from the battery, which is supplied to the heater 11, is controlled. In other words, the power from the battery, to be supplied to the heater 11, may be turned ON and OFF. The power from the battery is turned ON, that is, the power is supplied from the battery, when the capacitor or the like forming the battery is sufficiently charged. But the power from the battery is turned OFF, that is, no power is supplied from the battery, when the capacitor or the like forming the battery is insufficiently charged and the charge has not reached a level which enables a stable power supply. On the other hand, the heaters 12 and 13 receive power from an external power supply, such as a commercial A.C. power supply, which can constantly supply power, and heat the fixing roller 1 by radiating heat towards the inner peripheral surface of the fixing roller 1. The power from the external power supply can constantly be supplied to the heater 12 and 13.

The capacitor is a D.C. power supply forming the battery. It is possible to use an electric double layer capacitor or the like having an electrostatic capacitance of the farad (F) order or greater. For example, the battery may be formed by a capacitor module which is made up of a plurality of capacitor cells which are connected in series and/or in parallel. In this case, each capacitor cell may have a capacitance of approximately 300 F to 1500 F at a rated voltage of 2.5 V, so as to realize a high output voltage of approximately 30 V to 200 V from the capacitor module.

The heaters 11, 12 and 13 are disposed symmetrically about the center shaft of the fixing roller 1 at circumferential positions separated by a predetermined distance from the inner peripheral surface of the fixing roller 1. A distance $L_D$ from the heater 11 to the temperature detecting position of the temperature sensor 3 is greater than or equal to a distance $L_A$ from the heater 13 to the temperature detecting position of the temperature sensor 3. That is, $L_A \leqq L_D$, and the heater 13 is closer to the temperature detecting position than the heater 11.

At the time of starting the fixing unit 10, the fixing roller 1 is heated in a state where the fixing roller 1 is stationary, based on the surface temperature of the stationary fixing roller 1 which is detected by the temperature sensor 3. In other words, the power from the external power supply is supplied to the heaters 12 and 13, and if the surface temperature of the fixing roller 1 detected by the temperature sensor 3 has not yet reached a predetermined temperature, the power from the battery is supplied to the heater 11 (power supply from the battery to the heater 11 is turned ON). If the surface temperature of the fixing roller 1 detected by the temperature sensor 3 reaches an upper limit value of the predetermined temperature, the supply of power from the capacitor to the heater 11 is cut off by a switch or the like (power supply from the battery to the heater 11 is turned OFF). Alternatively, the surface temperature of the fixing roller 1 after a predetermined time is predicted from the surface temperature of the fixing roller 1 and a temperature rising (or heating) gradient thereof, and the power supply from the capacitor to the heater 11 is cut off so that the predicted surface temperature does not exceed the upper limit value of the predetermined temperature. At the same time, the supply of power from the external power supply to the heaters 12 and 13 is continued, but the amount of power supplied to the heaters 12 and 13 is suppressed to such an extent that the surface temperature of the fixing roller 1 can be maintained to the reload temperature.

In the fixing unit 10, the method of fixing the toner (or toner image) on the recording medium is the same as that used in the conventional or existing fixing units.

By employing the heater arrangement described above for the heaters 11 through 13, the heater 11 will not block the heat radiated from the heater 12 and/or the heater 13 during a heating process such as that at the time of starting the fixing unit 10, even when the charge in the capacitor is insufficient and the capacitor cannot supply power to the heater 11. For this reason, it is possible to match the surface temperature detected by the temperature sensor 3 and the nip temperature in the vicinity of the nip part, and simultaneously prevent the surface temperature of the fixing roller 1 from rising to an undesirable high temperature so as to ensure safe heating of the fixing roller 1 within a range less than or equal to the set temperature when at least one heater (heater 11 in this embodiment) is designed to receive power from a battery (capacitor in this embodiment), so as to more positively ensure safety.

Next, a description will be given of first and second modifications of the first embodiment of the fixing unit, by referring to FIGS. 6 and 7.

Figure 6:
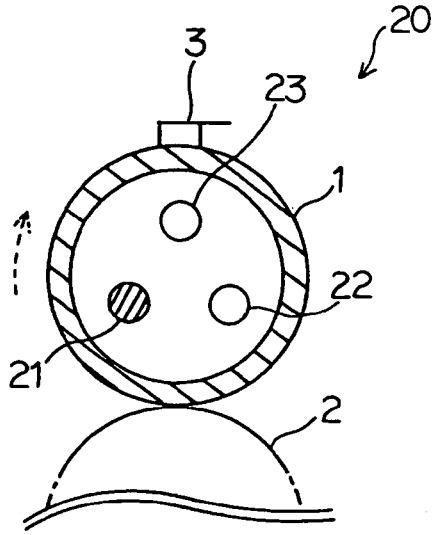
FIG. 6 is a cross sectional view showing a part of a first modification of the first embodiment of the fixing unit.

FIG. 6 is a cross sectional view showing a part of the first modification of the first embodiment of the fixing unit. A fixing unit 20 shown in FIG. 6 only differs from the fixing unit 10 shown in FIG. 5, in that heaters 21, 22 and 23 have a heater arrangement different from that of the heaters 11, 12 and 13. Otherwise, the basic structure and the power supply control employed by the fixing unit 20 are basically the same as those employed by the fixing unit 10.

In FIG. 6, the heater 21 receives power from a battery, such as a capacitor, and heats the fixing roller 1 by radiating heat towards the inner peripheral surface of the fixing roller 1. The power from the battery, which is supplied to the heater 21, is controlled. In other words, the power from the battery, to be supplied to the heater 21, may be turned ON and OFF. On the other hand, the heaters 22 and 23 receive power from an external power supply such as a commercial A.C. power supply, and heat the fixing roller 1 by radiating heat towards the inner peripheral surface of the fixing roller 1. The power from the external power supply can constantly be supplied to the heater 22 and 23.

The heaters 21, 22 and 23 are disposed symmetrically about the center shaft of the fixing roller 1 at circumferential positions separated by a predetermined distance from the inner peripheral surface of the fixing roller 1. In addition, the heater 23 is located at a position closer to the temperature detecting position than the heater 21. In other words, of the heaters 22 and 23 which can constantly receive the power from the external power supply, the heater 23 which is closest to the temperature detecting position, is closer to the temperature detecting position than the heater 21 which is closest to the temperature detecting position of the heaters which receive the controlled power from the capacitor. In this modification, the heater 21 is closest to the temperature detecting position of the heaters which receive the controlled power from the capacitor, since only the heater 21 receives the controlled power from the capacitor.

Figure 7:
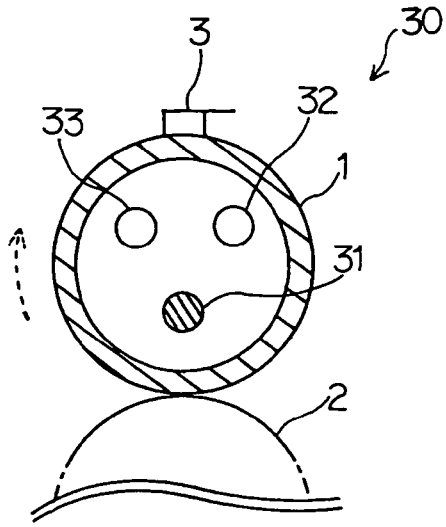
FIG. 7 is a cross sectional view showing a part of a second modification of the first embodiment of the fixing unit.

FIG. 7 is a cross sectional view showing a part of the second modification of the first embodiment of the fixing unit. A fixing unit 30 shown in FIG. 7 only differs from the fixing unit 10 shown in FIG. 5, in that heaters 31, 32 and 33 have a heater arrangement different from that of the heaters 11, 12 and 13. Otherwise, the basic structure and the power supply control employed by the fixing unit 30 are basically the same as those employed by the fixing unit 10.

In FIG. 7, the heater 31 receives power from a battery, such as a capacitor, and heats the fixing roller 1 by radiating heat towards the inner peripheral surface of the fixing roller 1. The power from the battery, which is supplied to the heater 31, is controlled. In other words, the power from the battery, to be supplied to the heater 31, may be turned ON and OFF. On the other hand, the heaters 32 and 33 receive power from an external power supply such as a commercial A.C. power supply, and heat the fixing roller 1 by radiating heat towards the inner peripheral surface of the fixing roller 1. The power from the external power supply can constantly be supplied to the heater 32 and 33.

The heaters 31, 32 and 33 are disposed symmetrically about the center shaft of the fixing roller 1 at circumferential positions separated by a predetermined distance from the inner peripheral surface of the fixing roller 1. In addition, the heater 33 (or heater 32) is located at a position closer to the temperature detecting position than the heater 31. In other words, of the heaters 32 and 33 which can constantly receive power from the external power supply, the heater 33 (or heater 32 since the heaters 32 and 33 are equidistant from the temperature detecting position) which is closest to the temperature detecting position, is closer to the temperature detecting position than the heater 31 which is closest to the temperature detecting position of the heaters which receive the controlled power from the capacitor. In this modification, the heater 31 is closest to the temperature detecting position of the heaters which receive the controlled power from the capacitor, since only the heater 31 receives the controlled power from the capacitor.

According to the first and second modifications of the first embodiment, the heater 21 or 31 will not block the heat radiated from the corresponding heaters 22 and 23 or 32 and 33 during a heating process such as that at the time of starting the fixing unit 20 or 30, even when the charge in the capacitor is insufficient and the capacitor cannot supply the power to the heater 21 or 31. For this reason, it is possible to match the surface temperature detected by the temperature sensor 3 and the nip temperature in the vicinity of the nip part, and simultaneously prevent the surface temperature of the fixing roller 1 from rising to an undesirable high temperature so as to ensure safe heating of the fixing roller 1 within a range less than or equal to the set temperature when at least one heater (heater 21 in the first modification and heater 31 in the second modification) is designed to receive power from a battery (capacitor in these modifications), so as to more positively ensure safety.

Figure 8:
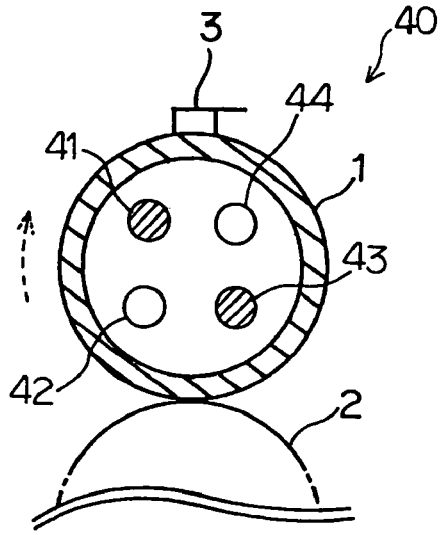
FIG. 8 is a cross sectional view showing a part of a second embodiment of the fixing unit according to the present invention.

Next, a description will be given of a second embodiment of the fixing unit according to the present invention, by referring to FIG. 8. FIG. 8 is a cross sectional view showing a part of the second embodiment of the fixing unit according to the present invention.

In a fixing unit 40 shown in FIG. 8, rod-shaped heaters 41, 42, 43 and 44 are disposed symmetrically about the center shaft of the fixing roller 1 at circumferential positions separated by a predetermined distance from the inner peripheral surface of the fixing roller 1. The heaters 41 and 43 receive power from a battery, such as a capacitor, and heat the fixing roller 1 by radiating heat towards the inner peripheral surface of the fixing roller 1. The power from the battery, which is supplied to the heaters 41 and 43, is controlled. In other words, the power from the battery, to be supplied to the heaters 41 and 43, may be turned ON and OFF. On the other hand, the heaters 42 and 44 receive power from an external power supply such as a commercial A.C. power supply, and heat the fixing roller 1 by radiating heat towards the inner peripheral surface of the fixing roller 1. The power from the external power supply can constantly be supplied to the heater 42 and 44.

The heaters 41 through 44 are disposed at the circumferential positions so that the heater (41, 43) which receives the controlled power from the battery and the heater (42, 44) which can constantly receive power from the external power supply are alternately arranged. In FIG. 8, the heaters are arranged in the order of the heaters 41, 42, 43 and 44 along the counterclockwise direction. Of the heaters 42 and 44 which can constantly receive power from the external power supply, the heater 44 which is closest to the temperature detecting position, has the same distance from the temperature detecting position as or is closer to the temperature detecting position than the heater 41 which is closest to the temperature detecting position of the heaters 41 and 43 which receive the controlled power from the capacitor.

At the time of starting the fixing unit 40, the fixing roller 1 is heated in a state where the fixing roller 1 is stationary, based on the surface temperature of the stationary fixing roller 1 which is detected by the temperature sensor 3. In other words, the power from the external power supply is supplied to the heaters 42 and 44, and if the surface temperature of the fixing roller 1 detected by the temperature sensor 3 has not yet reached a predetermined temperature, the power from the battery is supplied to the heaters 41 and 43 (power supply from the battery to the heaters 41 and 43 is turned ON). If the surface temperature of the fixing roller 1 detected by the temperature sensor 3 reaches an upper limit value of the predetermined temperature, the supply of power from the capacitor to the heaters 41 and 43 is cut off by a switch or the like (power supply from the battery to the heaters 41 and 43 is turned OFF). Alternatively, the surface temperature of the fixing roller 1 after a predetermined time is predicted from the surface temperature of the fixing roller 1 and a temperature rising (or heating) gradient thereof, and the power supply from the capacitor to the heaters 41 and 43 is cut off so that the predicted surface temperature does not exceed the upper limit value of the predetermined temperature. At the same time, the supply of power from the external power supply to the heaters 42 and 44 is continued, but the amount of power supplied to the heaters 42 and 44 is suppressed (or controlled) to such an extent that the surface temperature of the fixing roller 1 can be maintained to the reload temperature.

In the fixing unit 40, the method of fixing the toner (or toner image) on the recording medium is the same as that used in the conventional or existing fixing units.

By employing the heater arrangement described above for the heaters 41 through 44, the heater 41 will not block the heat radiated from the heater 44 during a heating process such as that at the time of starting the fixing unit 40, even when the charge in the capacitor is insufficient and the capacitor cannot supply power to the heaters 41 and 43. For this reason, it is possible to match the surface temperature detected by the temperature sensor 3 and the nip temperature in the vicinity of the nip part, and simultaneously prevent the surface temperature of the fixing roller 1 from rising to an undesirable high temperature so as to ensure safe heating of the fixing roller 1 within a range less than or equal to the set temperature when the heaters (heaters 41 and 43 in this embodiment) are designed to receive power from a battery (capacitor in this embodiment), so as to more positively ensure safety.

Furthermore, since the heaters 41 and 43 which receive the controlled power from the capacitor and the heaters 42 and 44 which can constantly receive power from the external power supply are alternately arranged along the circumferential positions within the fixing roller 1, the fixing roller 1 is uniformly heated along the circumferential direction, and the fixing roller 1 can be heated more safely within the range less than or equal to the set temperature. Moreover, even in a case where the charge in the capacitor is insufficient and the capacitor cannot supply power to the heaters 41 and 43, it is still possible to heat the fixing roller 1 in a relatively uniform manner.

Next, a description will be given of first through sixth modifications of the second embodiment of the fixing unit, by referring to FIGS. 9 through 14. The first through sixth modifications of the second embodiment shown in FIGS. 9 through 14 only differ from the second embodiment shown in FIG. 8, in that heater arrangements employed are different from that of the second embodiment. Otherwise, the basic structure and the power supply control employed by the first through sixth modifications of the second embodiment are basically the same as those employed by the second embodiment.

Figure 9:
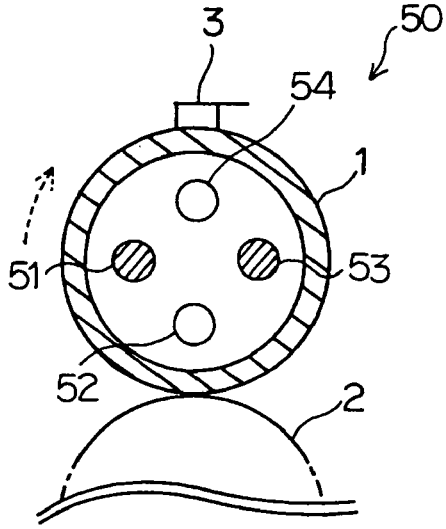
FIG. 9 is a cross sectional view showing a part of a first modification of the second embodiment of the fixing unit.

FIG. 9 is a cross sectional view showing a part of the first modification of the second embodiment of the fixing unit.

In a fixing unit 50 shown in FIG. 9, rod-shaped heaters 51, 52, 53 and 54 are disposed symmetrically about the center shaft of the fixing roller 1 at circumferential positions separated by a predetermined distance from the inner peripheral surface of the fixing roller 1. The heaters 51 and 53 receive power from a battery, such as a capacitor, and heat the fixing roller 1 by radiating heat towards the inner peripheral surface of the fixing roller 1. The power from the battery, which is supplied to the heaters 51 and 53, is controlled. In other words, the power from the battery, to be supplied to the heaters 51 and 53, may be turned ON and OFF. On the other hand, the heaters 52 and 54 receive power from an external power supply such as a commercial A.C. power supply, and heat the fixing roller 1 by radiating heat towards the inner peripheral surface of the fixing roller 1. The power from the external power supply can constantly be supplied to the heater 52 and 54.

The heaters 51 through 54 are disposed at the circumferential positions so that the heater (51, 53) which receives the controlled power from the battery and the heater (52, 54) which can constantly receive power from the external power supply are alternately arranged. In FIG. 9, the heaters are arranged in the order of the heaters 51, 52, 53 and 54 along the counterclockwise direction, in a state which is rotated by 45 degrees with respect to the heater arrangement of the fixing unit 40 shown in FIG. 8. Of the heaters 52 and 54 which can constantly receive power from the external power supply, the heater 54 which is closest to the temperature detecting position, is closer to the temperature detecting position than the heater 51 (or heater 53 since the heaters 51 and 53 are equidistant from the temperature detecting position) which is closest to the temperature detecting position of the heaters 51 and 53 which receive the controlled power from the capacitor.

Figure 10:
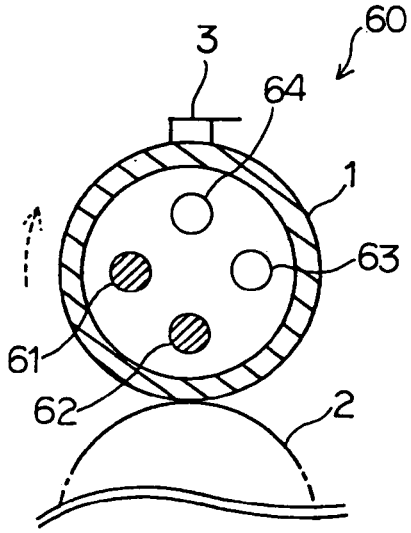
FIG. 10 is a cross sectional view showing a part of a second modification of the second embodiment of the fixing unit.

FIG. 10 is a cross sectional view showing a part of the second modification of the second embodiment of the fixing unit.

In a fixing unit 60 shown in FIG. 10, rod-shaped heaters 61, 62, 63 and 64 are disposed symmetrically about the center shaft of the fixing roller 1 at circumferential positions separated by a predetermined distance from the inner peripheral surface of the fixing roller 1. The heaters 61 and 62 receive power from a battery, such as a capacitor, and heat the fixing roller 1 by radiating heat towards the inner peripheral surface of the fixing roller 1. The power from the battery, which is supplied to the heaters 61 and 62, is controlled. In other words, the power from the battery, to be supplied to the heaters 61 and 62, may be turned ON and OFF. On the other hand, the heaters 63 and 64 receive power from an external power supply such as a commercial A.C. power supply, and heat the fixing roller 1 by radiating heat towards the inner peripheral surface of the fixing roller 1. The power from the external power supply can constantly be supplied to the heater 63 and 64.

The heaters 61 through 64 are disposed at the circumferential positions so that the heaters 61 and 62 which receive the controlled power from the battery are arranged side by side, and the heaters 63 and 64 which can constantly receive power from the external power supply are arranged side by side, in this order along the counterclockwise direction in FIG. 10, in a state which is equivalent to interchanging sources of the power supply to the heaters 52 and 53 in the fixing unit 50 shown in FIG. 9. Of the heaters 63 and 64 which can constantly receive power from the external power supply, the heater 64 which is closest to the temperature detecting position, is closer to the temperature detecting position than the heater 61 which is closest to the temperature detecting position of the heaters 61 and 62 which receive the controlled power from the capacitor.

Figure 11:
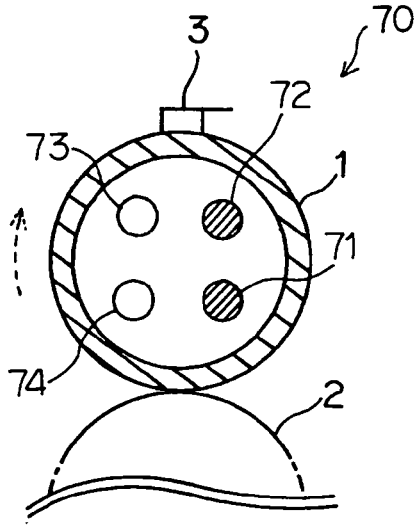
FIG. 11 is a cross sectional view showing a part of a third modification of the second embodiment of the fixing unit.

FIG. 11 is a cross sectional view showing a part of the third modification of the second embodiment of the fixing unit.

In a fixing unit 70 shown in FIG. 11, rod-shaped heaters 71, 72, 73 and 74 are disposed symmetrically about the center shaft of the fixing roller 1 at circumferential positions separated by a predetermined distance from the inner peripheral surface of the fixing roller 1. The heaters 71 and 72 receive power from a battery, such as a capacitor, and heat the fixing roller 1 by radiating heat towards the inner peripheral surface of the fixing roller 1. The power from the battery, which is supplied to the heaters 71 and 72, is controlled. In other words, the power from the battery, to be supplied to the heaters 71 and 72, may be turned ON and OFF. On the other hand, the heaters 73 and 74 receive power from an external power supply such as a commercial A.C. power supply, and heat the fixing roller 1 by radiating heat towards the inner peripheral surface of the fixing roller 1.

The power from the external power supply can constantly be supplied to the heater 73 and 74.

The heaters 71 through 74 are disposed at the circumferential positions so that the heaters 71 and 72 which receive the controlled power from the battery are arranged side by side, and the heaters 73 and 74 which can constantly receive power from the external power supply are arranged side by side, in this order along the counterclockwise direction in FIG. 11, in a state which is equivalent to interchanging sources of the power supply to the heaters 41 and 44 in the fixing unit 40 shown in FIG. 8. Of the heaters 73 and 74 which can constantly receive power from the external power supply, the heater 73 which is closest to the temperature detecting position, is the same distance from the temperature detecting position as or is closer to the temperature detecting position than the heater 72 which is closest to the temperature detecting position of the heaters 71 and 72 which receive the controlled power from the capacitor.

Figure 12:
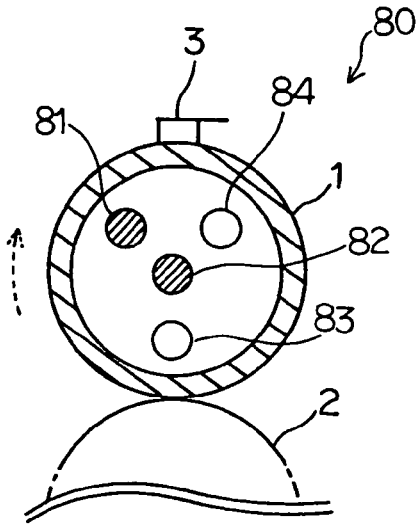
FIG. 12 is a cross sectional view showing a part of a fourth modification of the second embodiment of the fixing unit.

FIG. 12 is a cross sectional view showing a part of the fourth modification of the second embodiment of the fixing unit.

In a fixing unit 80 shown in FIG. 12, rod-shaped heaters 81, 83 and 84 are disposed symmetrically about a rod-shaped heater 82 which is disposed at the center shaft of the fixing roller 1, at circumferential positions separated by a predetermined distance from the inner peripheral surface of the fixing roller 1. The heaters 81 and 82 receive power from a battery, such as a capacitor, and heat the fixing roller 1 by radiating heat towards the inner peripheral surface of the fixing roller 1. The power from the battery, which is supplied to the heaters 81 and 82, is controlled. In other words, the power from the battery, to be supplied to the heaters 81 and 82, may be turned ON and OFF. On the other hand, the heaters 83 and 84 receive power from an external power supply such as a commercial A.C. power supply, and heat the fixing roller 1 by radiating heat towards the inner peripheral surface of the fixing roller 1. The power from the external power supply can constantly be supplied to the heater 83 and 84.

The heaters 81, 83 and 84 are disposed at the circumferential positions so that the heater 81 which receives the controlled power from the battery, and the heaters 83 and 84 which can constantly receive power from the external power supply are arranged in this order along the counterclockwise direction in FIG. 12, with the heater 82 which receives the controlled power from the battery disposed at the center of the fixing roller 1. Of the heaters 83 and 84 which can constantly receive power from the external power supply, the heater 84 which is closest to the temperature detecting position, is the same distance from the temperature detecting position as or is closer to the temperature detecting position than the heater 81 which is closest to the temperature detecting position of the heaters 81 and 82 which receive the controlled power from the capacitor.

Figure 13:
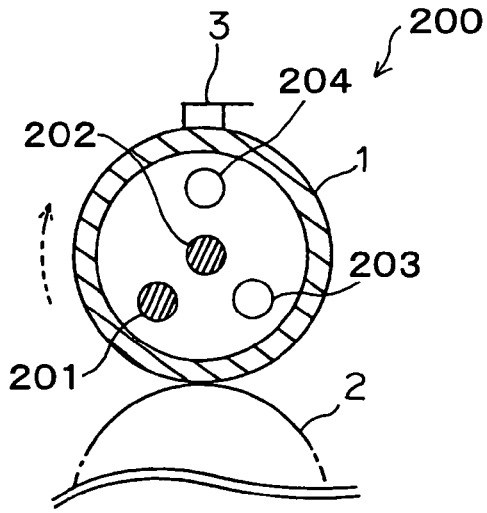
FIG. 13 is a cross sectional view showing a part of a fifth modification of the second embodiment of the fixing unit.

FIG. 13 is a cross sectional view showing a part of the fifth modification of the second embodiment of the fixing unit.

In a fixing unit 200 shown in FIG. 13, rod-shaped heaters 201, 203 and 204 are disposed symmetrically about a rod-shaped heater 202 which is disposed at the center shaft of the fixing roller 1, at circumferential positions separated by a predetermined distance from the inner peripheral surface of the fixing roller 1. The heaters 201 and 202 receive power from a battery, such as a capacitor, and heat the fixing roller 1 by radiating heat towards the inner peripheral surface of the fixing roller 1. The power from the battery, which is supplied to the heaters 201 and 202, is controlled. In other words, the power from the battery, to be supplied to the heaters 201 and 202, may be turned ON and OFF. On the other hand, the heaters 203 and 204 receive power from an external power supply such as a commercial A.C. power supply, and heat the fixing roller 1 by radiating heat towards the inner peripheral surface of the fixing roller 1. The power from the external power supply can constantly be supplied to the heater 203 and 204.

The heaters 201, 203 and 204 are disposed at the circumferential positions so that the heater 201 which receives the controlled power from the battery, and the heaters 203 and 204 which can constantly receive power from the external power supply are arranged in this order along the counterclockwise direction in FIG. 13, with the heater 202 which receives the controlled power from the battery disposed at the center of the fixing roller 1. Of the heaters 203 and 204 which can constantly receive power from the external power supply, the heater 204 which is closest to the temperature detecting position, is closer to the temperature detecting position than the heater 202 which is closest to the temperature detecting position of the heaters 201 and 202 which receive the controlled power from the capacitor.

Figure 14:
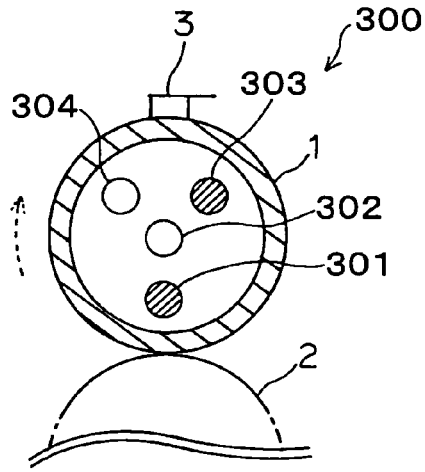
FIG. 14 is a cross sectional view showing a part of a sixth modification of the second embodiment of the fixing unit.

FIG. 14 is a cross sectional view showing a part of the sixth modification of the second embodiment of the fixing unit.

In a fixing unit 300 shown in FIG. 14, rod-shaped heaters 301, 303 and 304 are disposed symmetrically about a rod-shaped heater 302 which is disposed at the center shaft of the fixing roller 1, at circumferential positions separated by a predetermined distance from the inner peripheral surface of the fixing roller 1. The heaters 301 and 303 receive power from a battery, such as a capacitor, and heat the fixing roller 1 by radiating heat towards the inner peripheral surface of the fixing roller 1. The power from the battery, which is supplied to the heaters 81 and 82, is controlled. In other words, the power from the battery, to be supplied to the heaters 301 and 303, may be turned ON and OFF. On the other hand, the heaters 302 and 304 receive power from an external power supply such as a commercial A.C. power supply, and heat the fixing roller 1 by radiating heat towards the inner peripheral surface of the fixing roller 1. The power from the external power supply can constantly be supplied to the heater 302 and 304.

The heaters 301, 303 and 304 are disposed at the circumferential positions so that the heaters 301 and 302 which receive the controlled power from the battery, and the heater 304 which can constantly receive power from the external power supply are arranged in this order along the counterclockwise direction in FIG. 14, with the heater 302 which receives the controlled power from the battery disposed at the center of the fixing roller 1. Of the heaters 302 and 304 which can constantly receive power from the external power supply, the heater 304 which is closest to the temperature detecting position, is the same distance from the temperature detecting position as or is closer to the temperature detecting position than the heater 303 which is closest to the temperature detecting position of the heaters 301 and 303 which receive the controlled power from the capacitor.

According to the first through sixth modifications of the second embodiment, the heater which receives the power supply from the capacitor will not block the heat radiated from the other heaters during a heating process such as that at the time of starting the fixing unit 50, 60, 70, 80, 200 or 300, even when the charge in the capacitor is insufficient and the capacitor cannot supply the power to the heaters which are to receive the power supply from the capacitor. For this reason, it is possible to match the surface temperature detected by the temperature sensor 3 and the nip temperature in the vicinity of the nip part, and simultaneously prevent the surface temperature of the fixing roller 1 from rising to an undesirable high temperature so as to ensure safe heating of the fixing roller 1 within a range less than or equal to the set temperature when one or more heaters are designed to receive power from a battery (capacitor in these modifications embodiment), so as to more positively ensure safety.

In the fixing unit of the present invention, it is not essential for the temperature detecting position of the temperature sensor 3 to be located at the diametrically opposite position from the nip part as shown in FIGS. 5 through 14. The temperature detecting position of the temperature sensor 3 may be set to an arbitrary position on or with respect to the fixing roller 1, as long as it is possible to satisfy a relationship such that a heater (for example, the heater 13 shown in FIG. 5) which can constantly be supplied with the power and is located closest to the temperature detecting position is the same distance from the temperature detecting position as or is closer to the temperature detecting position than a heater (for example, the heater 11 shown in FIG. 5) which is supplied with the controlled power which is turned ON and OFF.

In addition to the method of switching the power supply from the capacitor ON and OFF with respect to the heater which is to receive the power supply from the capacitor as employed in the embodiments and modifications described above, it is possible to employ other methods of controlling the power supply. For example, it is possible to employ a Proportional-Integral-Differential (PID) control (or PID control algorithm) which provides a fine and smooth control by feeding back the amount of power to be supplied based on a relationship of the present temperature which is detected by the temperature sensor 3 with respect to a target temperature of the fixing roller 1 and the past temperature changes of the fixing roller 1 which are stored.

Figure 15:
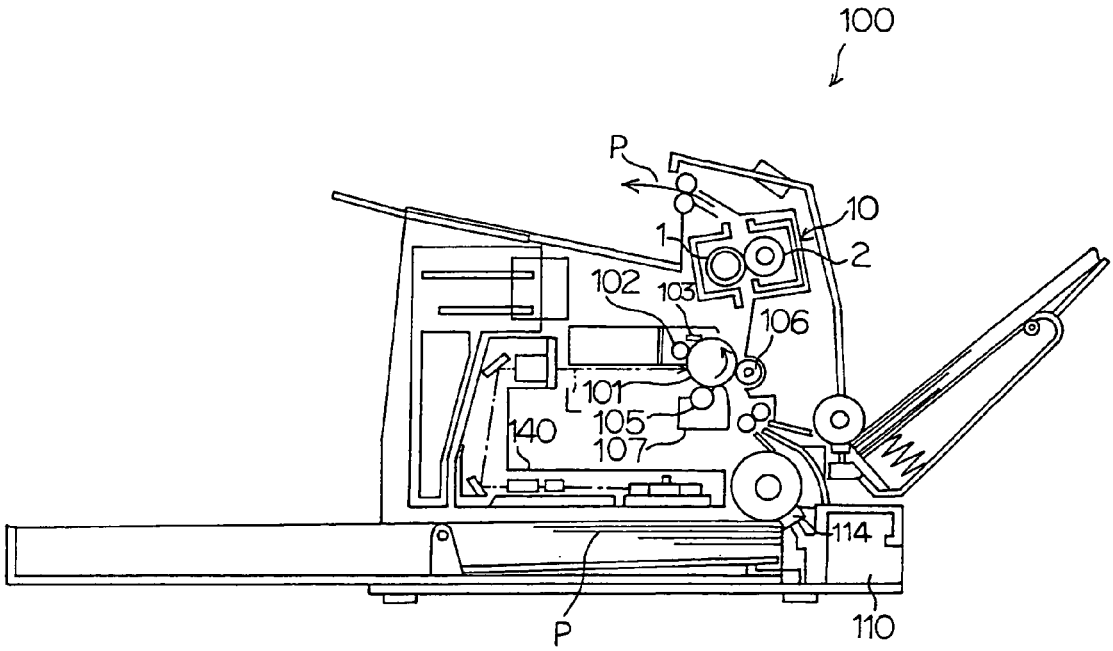
FIG. 15 is a cross sectional view showing an embodiment of an image forming apparatus according to the present invention.

Next, a description will be given of an embodiment of the image forming apparatus according to the present invention, by referring to FIG. 15. FIG. 15 is a cross sectional view showing the embodiment of an image forming apparatus according to the present invention. For the sake of convenience, it is assumed that the image forming apparatus employs the fixing unit 10 shown in FIG. 5. However, the image forming apparatus may of course employ the fixing unit of any of the embodiments and modifications described above. Only parts of the image forming apparatus directly related to the subject matter of the present invention will be described with reference to FIG. 15, since the basic structure of the image forming apparatus shown in FIG. 15 are described in detail in the Japanese Laid-Open Patent Application No.2002-174988.

An image forming apparatus 100 shown in FIG. 15 generally includes a photoconductive body (or image bearing member) 101 which has a drum shape in this embodiment, a charging unit 102 which uniformly charges the surface of the photoconductive body 101 which has been cleaned by the scraper blade 103, a laser optical system 140 which forms an electrostatic latent image on the charged surface of the photoconductive body 101 by exposing the charge surface by a laser beam, and a developing unit 107 including a developing roller 105, which develops the electrostatic latent image on the surface of the photoconductive body 101 into a toner image. In addition, the toner image on the surface of the photoconductive body 101 is transferred onto a recording medium P which is supplied from a paper supply cassette 110 by a pick up unit 114 of the supply cassette 110, by a transfer unit 106. The recording medium P having the toner image formed thereon is transported to the fixing unit 10. In the fixing unit 10, the recording medium P is heated and pressed by the fixing roller 1 and the pressure roller 2, and the toner image is fixed on the recording medium P. Hence, the image is formed on the recording medium P by an electrophotography technique.

When the main power supply of the image forming apparatus 100 is turned ON, each part of the image forming apparatus 100 is started, and the fixing unit 10 is simultaneously started therewith. Hence, the power supply to the heaters 11 through 13 of the fixing unit 10 is started, and the heating of the fixing roller 1 is started. In this state, the surface temperature of the fixing roller 1 is detected and the power supply to the heaters 11 through 13 is controlled, so that the surface temperature of the fixing roller 1 is prevented from rising to an undesirable high temperature so as to ensure safe heating of the fixing roller 1 within a range less than or equal to the set temperature when at least one heater (heater 11 in this embodiment) is designed to receive power from a battery (capacitor in this embodiment), so as to more positively ensure safety. Therefore, a satisfactory image can be formed on the recording medium P.

Next, a description will be given of a third embodiment of the fixing unit according to the present invention, by referring to FIGS. 16 through 20. This third embodiment of the fixing unit may also be applied to the image forming apparatus shown in FIG. 15.

Figure 16:
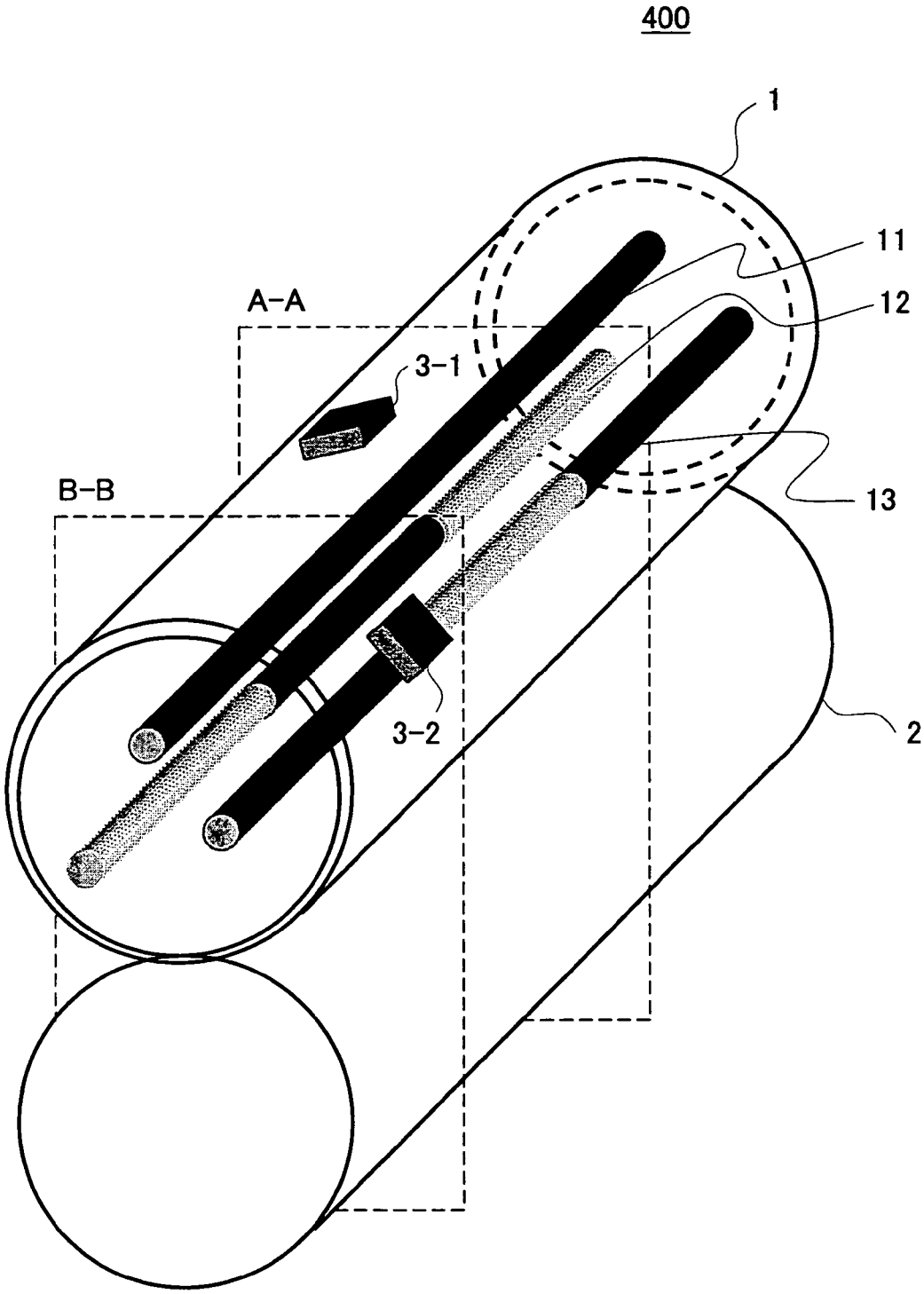
FIG. 16 is a perspective view showing a part of a third embodiment of the fixing unit according to the present invention.
Figure 17:
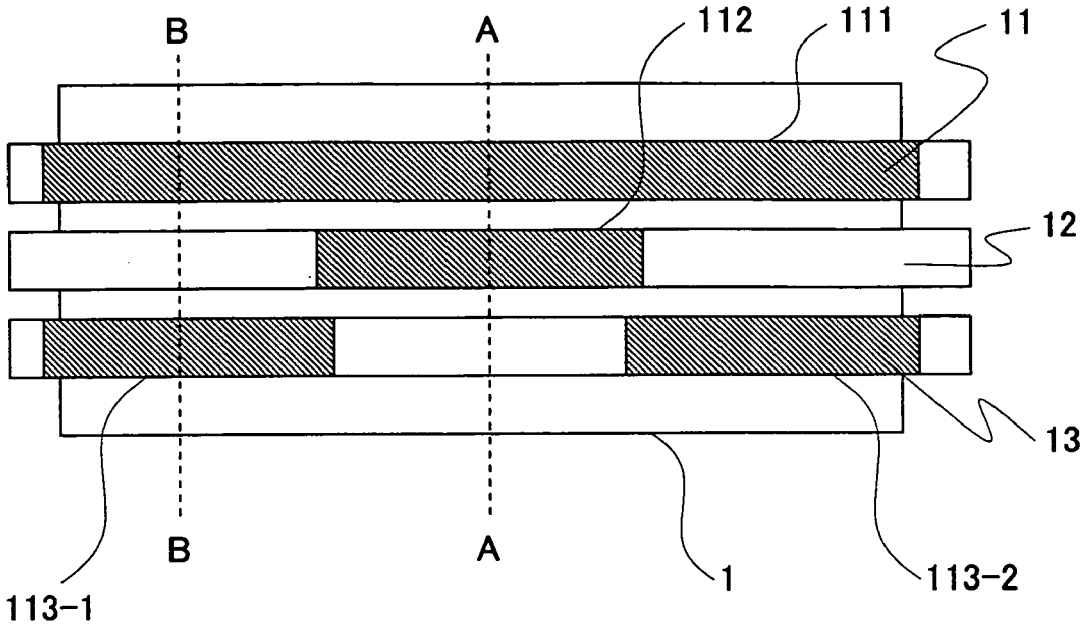
FIG. 17 is a side view showing a fixing roller shown in FIG. 16.
Figure 18:
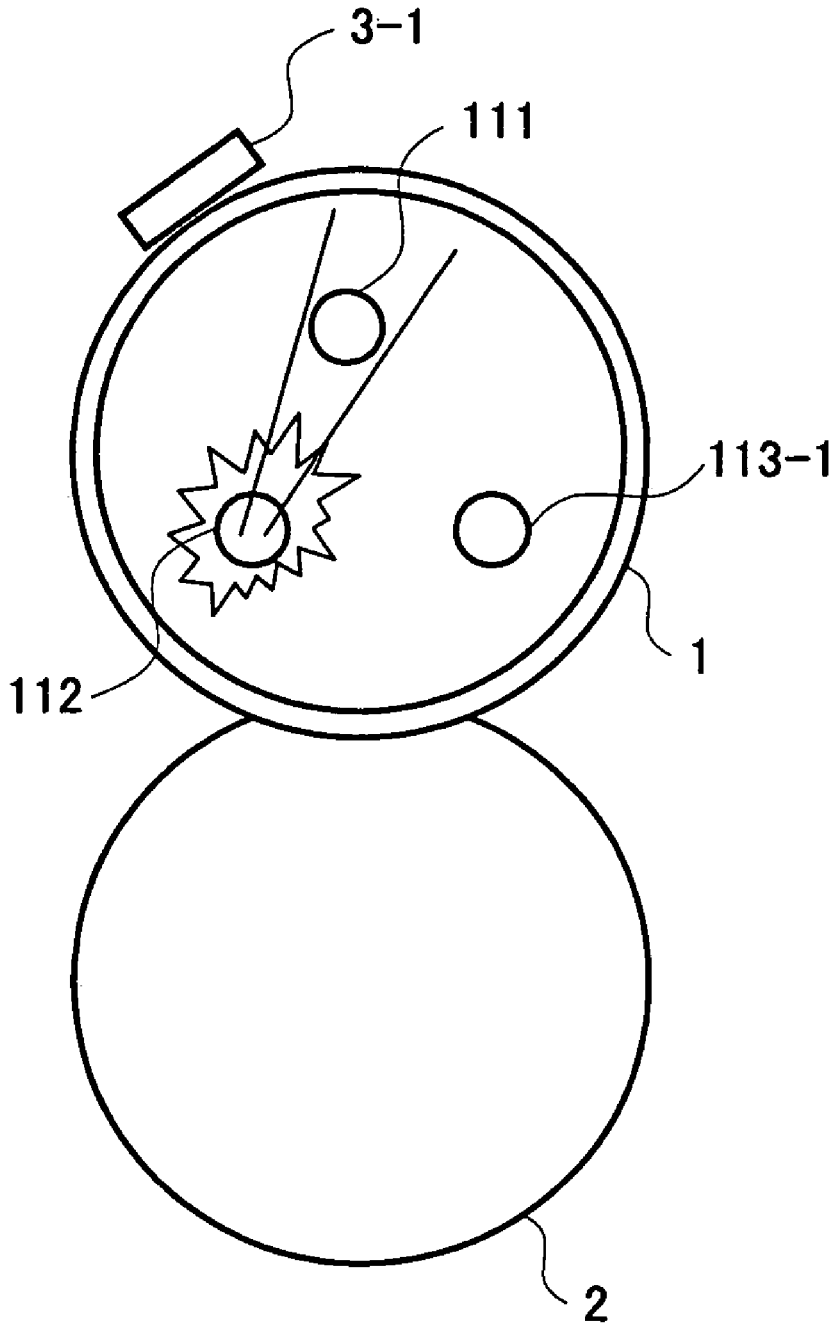
FIG. 18 is a cross sectional view of the fixing unit cut along a line A—A in FIG. 16.
Figure 19:
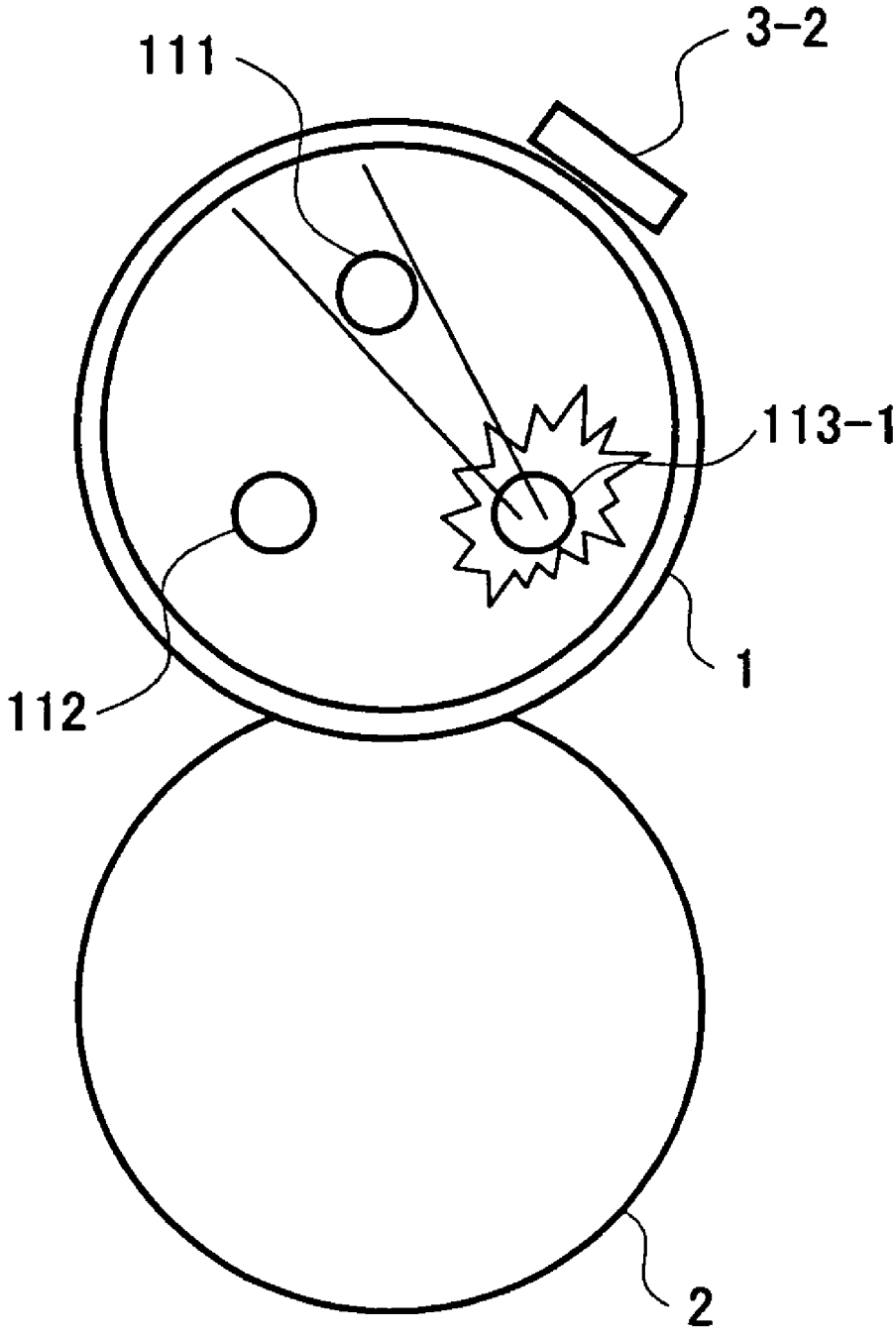
FIG. 19 is a cross sectional view of the fixing unit cut along a line B—B in FIG. 16.
Figure 20:
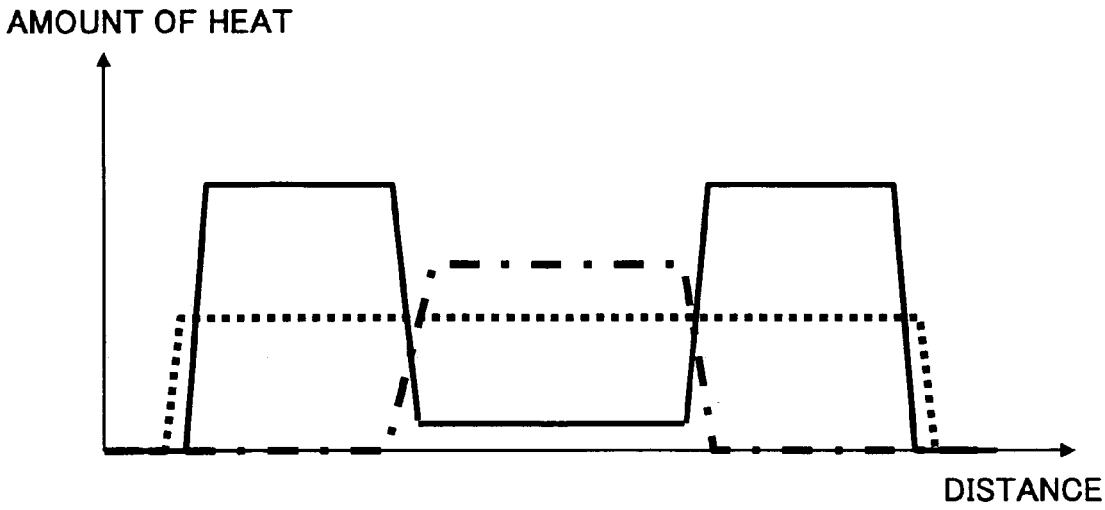
FIG. 20 is a diagram showing amounts of heat generated by heater parts of the heaters in the third embodiment of the fixing unit.

FIG. 16 is a perspective view showing a part of the third embodiment of the fixing unit. FIG. 17 is a side view showing a fixing roller shown in FIG. 16. FIG. 18 is a cross sectional view of the fixing unit cut along a line A—A in FIG. 16, and FIG. 19 is a cross sectional view of the fixing unit cut along a line B—B in FIG. 16. Further, FIG. 20 is a diagram showing amounts of heat generated by heater parts of the heaters. In FIGS. 16 through 19, those parts which are essentially the same as those corresponding parts shown in FIGS. 5 through 14 are designated by the same reference numerals, and a description thereof will be omitted.

In this embodiment, the heater 11 of a fixing unit 400 is made up of a single heater part 111, the heater 12 is made up of a center heater part 112, and the heater 13 is made up of a pair of end heater parts 113-1 and 113-2, as shown in FIG. 17. A temperature sensor 3-1 provided at a position corresponding to the center heater part 112, so as to detect the surface temperature of the fixing roller 1. A temperature sensor 3-2 is provided at a position corresponding to one of the end heater parts 113-1 and 113-2, namely, the end heater part 113-1 in this embodiment, so as to detect the surface temperature of the fixing roller 1. The temperature sensor 3-2 is only provided with respect to one of symmetrically arranged heater parts 113-1 and 113-2 of the heater 13, because the fixing unit 400 of this embodiment has an approximately symmetrical configuration on both sides with respect to the central portion of the fixing roller 1 along the longitudinal direction thereof. In other words, it is assumed that the surface temperature of the fixing roller 1 undergoes approximately the same change on both end portions of the fixing roller 1.

As shown in FIG. 17, the center heater part 112 and the pair of end heater parts 113-1 and 113-2 partially overlap in the longitudinal direction of the fixing roller 1, so as to realize an approximately uniform temperature distribution along the longitudinal direction of the fixing roller 1. However, it is not essential to provide the partial overlap of the heater parts.

The temperature sensor 3-1 is provided with respect to the center heater part 112 as shown in FIG. 18, and the temperature sensor 3-2 is provided with respect to the end heater part 113-1 as shown in FIG. 19. The temperature detecting positions of the two temperature sensors 3-1 and 3-2 are mutually different along the circumferential direction of the fixing roller 1, as may be seen by comparing FIGS. 18 and 19. Furthermore, the temperature sensors 3-1 and 3-2 are provided at positions which are substantially unaffected by the blocking of heat from the heaters 12 and 13 by the heater 11.

In FIG. 20, the ordinate indicates the amount of heat generated in arbitrary units, and the abscissa indicates the distance along the longitudinal direction of the fixing roller 1 in arbitrary units. A dotted line indicates the amount of heat generated by the heater part 111 of the heater 11 which is driven by the battery. A one-dot chain line indicates the amount of heat generated by the center heater part 112 of the heater 12 which is driven by the external power supply such as the commercial A.C. power supply. A solid line indicates the amount of heat generated by the pair of end heater parts 113-1 and 113-2 of the heater 13 which is driven by the external power supply such as the commercial A.C. power supply.

In this embodiment, the controlled power supplied to the heater part 111 of the heater 11 is turned ON and OFF, and the controlled power supplied to each of the heater parts 112, 113-1 and 113-2 of the heaters 12 and 13 is variable in a plurality of levels. However, it is of course possible to make the controlled power supplied to the heater part 111 of the heater 11 variable in a plurality of levels. In other words, the PID control is not limited to the heaters 12 and 13 which are driven by the external power supply, and is similarly applicable also to the heater 11 which is driven by the battery. Moreover, it is also possible to make the controlled power supplied to each of the heater parts 112, 113-1 and 113-2 of the heaters 12 and 13 assume one of ON and OFF states.

Each of the heater parts 111, 112, 113-1 and 113-2 may be formed by a halogen lamp, a carbon heater, an induction heater and the like. In addition, a heater having a configuration which permits different amounts of heat to be generated in response to the same driving power at different positions along the longitudinal direction of the heater, may be used for any of the heater parts 111, 112, 113-1 and 113-2. The driving power may be controlled based on an amplitude of the current or voltage, or a number of driving pulses. When the heater having such a configuration is used for the heater part 111 of the heater 11, for example, the heater 11 may be driven as shown in FIG. 21.

Figure 21:
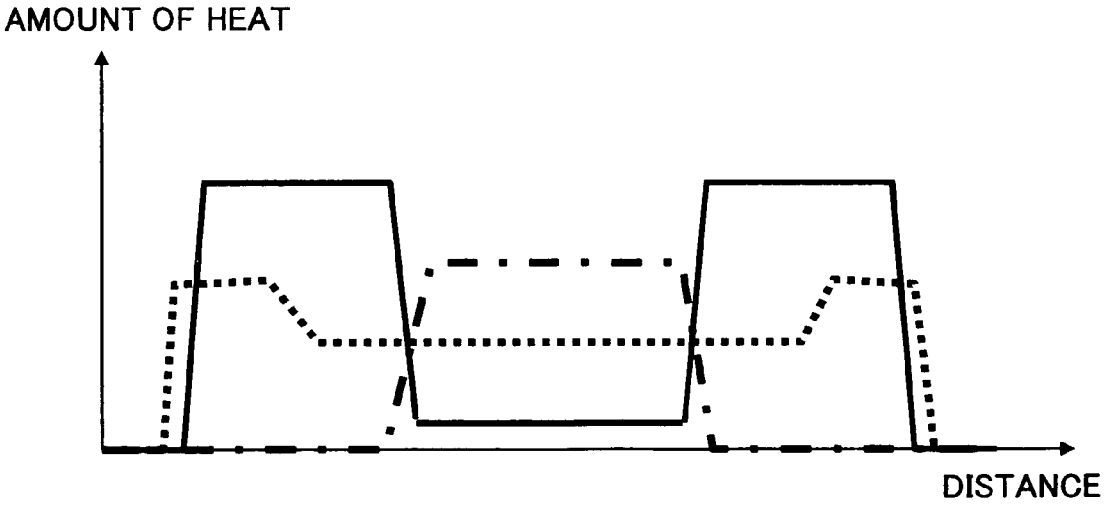
FIG. 21 is a diagram showing amounts of heat generated by heater parts of the heaters in a modification of the third embodiment of the fixing unit.

FIG. 21 is a diagram showing amounts of heat generated by heater parts of the heaters in a modification of the third embodiment of the fixing unit. In FIG. 21, the ordinate indicates the amount of heat generated in arbitrary units, and the abscissa indicates the distance along the longitudinal direction of the fixing roller 1 in arbitrary units. A dotted line indicates the amount of heat generated by the heater part 111 of the heater 11 which is driven by the battery. A one-dot chain line indicates the amount of heat generated by the center heater part 112 of the heater 12 which is driven by the external power supply such as the commercial A.C. power supply. A solid line indicates the amount of heat generated by the pair of end heater parts 113-1 and 113-2 of the heater 13 which is driven by the external power supply such as the commercial A.C. power supply. As may be seen from FIG. 21, the amount of heat generated by the heater part 111 of the heater 11 is larger at both end portions along the longitudinal direction of the fixing roller 1, so as to compensate for a temperature drop which is likely to occur immediately after at least the heater 11 is driven due to heat which escapes from the end portions of the fixing roller 1 via gears and other mechanical parts, for example. According to this modification, it is possible to more positively control the surface temperature of the fixing roller 1 to become approximately uniform along the longitudinal direction of the fixing roller 1.

In a case where the halogen lamp or the like is used for the heaters 11 through 13, the ordinate in FIGS. 20 and 21 corresponds to the intensity of light emitted from the halogen lamp or the like, in arbitrary units.

Of course, the heater 11 which is driven by the battery may be replaced by a plurality of heaters each formed by a plurality of heater parts, similarly to the heater 13. In addition, the heater 12 which is driven by the external power supply may also be formed by a plurality of heater parts, similarly to the heater 13. Moreover, the number of heater parts forming the heaters 11 through 13 is not limited to a predetermined value. However, it is preferable to set the number and the arrangement of heater parts so as to enable uniform heating of the fixing roller 1 along the longitudinal direction of the fixing roller 1.

Next, a description will be given of embodiments of the method of determining the temperature detecting position of the temperature sensor according to the present invention.

Figure 22:
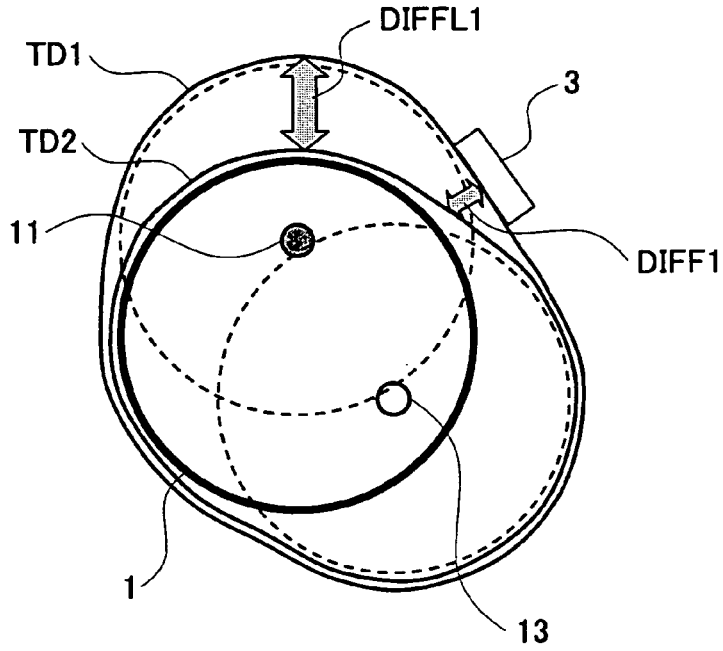
FIG. 22 is a diagram for explaining a first embodiment of a method of determining a temperature detecting position of a temperature sensor according to the present invention.

FIG. 22 is a diagram for explaining a first embodiment of the method of determining the temperature detecting position of the temperature sensor according to the present invention. In FIG. 22, those parts which are the same as those corresponding parts in FIGS. 1 through 14 and 16 through 19 are designated by the same reference numerals, and a description thereof will be omitted. Further, the illustration of the heater 12 is omitted, so as to simplify the temperature distribution of the surface temperature of the fixing roller 1.

In this embodiment of the method of determining the temperature detecting position of the temperature sensor 3 which is configured to detect the surface temperature of the fixing roller 1 having the plurality of internal heaters 11 through 13 which receive power based on the surface temperature detected by the temperature sensor 3, at least the heater 11 is capable of receiving power from a battery, and the remaining heaters 12 and 13 are capable of receiving power from an external power supply such as a commercial A.C. power supply. The method includes the following steps:

ST1: To obtain a first temperature distribution TD1 of the surface temperature of the fixing roller 1 when the heater 11 is ON and the heater 13 (that is, at least one of the heaters 12 and 13) is ON;

ST2: To obtain a second temperature distribution TD2 of the surface temperature of the fixing roller 1 when the heater 11 is OFF and the heater 13 (that is, at least the above one of the heaters 12 and 13) is ON; and ST3: To determine the temperature detecting position of the temperature sensor 3 to a location where a difference DIFF1 between the first and second temperature distributions TD1 and TD2 is smaller than a predetermined value.

In FIG. 22, DIFFL1 indicates a location where the difference between the first and second temperature distributions TD1 and TD2 is the predetermined value or larger and unsuited as the temperature detecting position of the temperature sensor 3.

Figure 23:
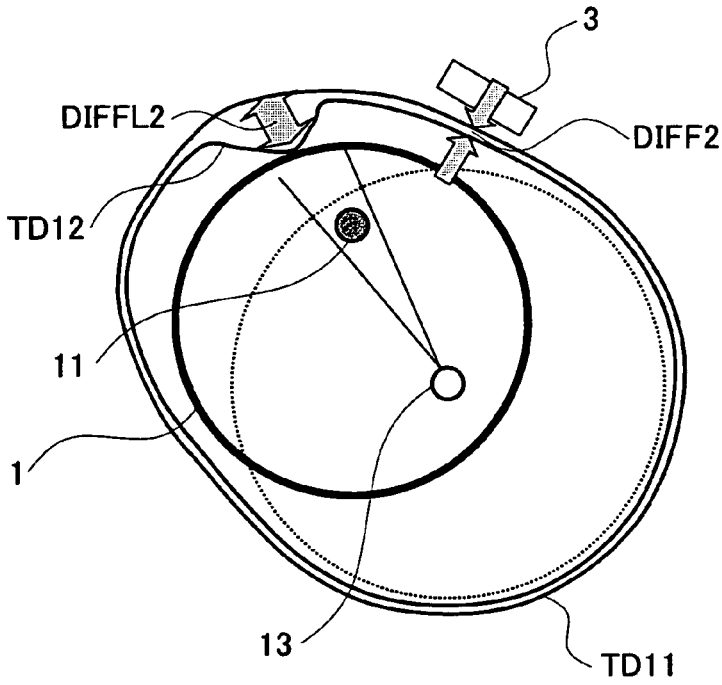
FIG. 23 is a diagram for explaining a second embodiment of a method of determining a temperature detecting position of a temperature sensor according to the present invention.

FIG. 23 is a diagram for explaining a second embodiment of the method of determining the temperature detecting position of the temperature sensor according to the present invention. In FIG. 23, those parts which are the same as those corresponding parts in FIGS. 1 through 14 and 16 through 19 are designated by the same reference numerals, and a description thereof will be omitted. Further, the illustration of the heater 12 is omitted, so as to simplify the temperature distribution of the surface temperature of the fixing roller 1.

In this embodiment of the method of determining the temperature detecting position of the temperature sensor 3 which is configured to detect the surface temperature of the fixing roller 1 having the plurality of internal heaters 11 through 13 which receive power based on the surface temperature detected by the temperature sensor 3, at least the heater 11 is capable of receiving power from a battery, the remaining heaters 12 and 13 are capable of receiving power from an external power supply such as a commercial A.C. power supply. The method includes the following steps:

ST11: To obtain a first temperature distribution TD11 of the surface temperature of the fixing roller 1 when no heater 11 is actually provided and the heater 13 (that is, at least one of the heaters 12 and 13) is ON;

ST12: To obtain a second temperature distribution TD12 of the surface temperature of the fixing roller 1 when the heater 11 is actually provided and the heater 13 (that is, at least the above one of the heaters 12 and 13) is ON; and ST13: To determine the temperature detecting position of the temperature sensor 3 to a location where a difference DIFF2 between the first and second temperature distributions TD11 and TD12 is smaller than a predetermined value.

In FIG. 23, DIFFL2 indicates a location where the difference between the first and second temperature distributions TD11 and TD12 is the predetermined value or larger and unsuited as the temperature detecting position of the temperature sensor 3.

Further, the present invention is not limited to these embodiments, but various variations and modifications may be made without departing from the scope of the present invention.

What is claimed is:

1. A fixing unit to thermally fix a toner on a recording medium, comprising:

a fixing member having a plurality of internal heaters, and an outer peripheral surface configured to fix the toner on the recording medium; and a temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, having a state which generates no heat in response to power supplied from a first power supply even during an operation of the fixing unit, remaining second heaters, of the plurality of heaters, being capable of constantly generating heat in response to power supplied from a second power supply during the operation of the fixing unit, one of the second heaters closest to the temperature detecting position is the same distance from the temperature detecting position as or is closer to the temperature detecting position than a first heater which is closest to the temperature detecting position.

2. The fixing unit as claimed in claim 1, wherein the first power supply comprises a battery.

3. The fixing unit as claimed in claim 2, wherein the battery comprises a capacitor.

4. The fixing unit as claimed in claim 1, wherein the first power supply comprises a battery, and the second power supply comprises a commercial A.C. power supply.

5. The fixing unit as claimed in claim 1, wherein the fixing member comprises a fixing roller, and the first heater and the second heater are alternately arranged along a circumferential direction of the fixing roller.

6. A fixing unit to thermally fix a toner on a recording medium, comprising:

a fixing member having a plurality of internal heaters, and an outer peripheral surface configured to fix the toner on the recording medium; and a temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, receiving the power from a first power supply, remaining second heaters, of the plurality of heaters, receiving the power from a second power supply which is different from the first power supply, one of the second heaters closest to the temperature detecting position is the same distance from the temperature detecting position as or is closer to the temperature detecting position than a first heater which is closest to the temperature detecting position.

7. The fixing unit as claimed in claim 6, wherein the first power supply comprises a battery.

8. The fixing unit as claimed in claim 6, wherein the first power supply comprises a capacitor.

9. The fixing unit as claimed in claim 6, wherein the first power supply comprises a battery, and the second power supply comprises a commercial A.C. power supply.

10. The fixing unit as claimed in claim 6, wherein the fixing member comprises a fixing roller, and the first heater and the second heater are alternately arranged symmetrically along a circumferential direction of the fixing roller relative to a center of the fixing roller.

11. The fixing unit as claimed in claim 6, wherein the fixing member comprises a fixing roller, and at least one first heater and a plurality of second heaters are arranged symmetrically along a circumferential direction of the fixing roller relative to a center of the fixing roller.

12. The fixing unit as claimed in claim 11, wherein another first heater is arranged at the center of the fixing roller.

13. The fixing unit as claimed in claim 11, wherein another second heater is arranged at the center of the fixing roller.

14. The fixing unit as claimed in claim 6, further comprising:

a pressing member configured to press against the fixing member and to receive the recording medium transported between the pressing member and the fixing member.

15. An image forming apparatus adapted to form an image on a recording medium by an electrophotography technique, comprising:

an image forming unit configured to form a toner image on a recording medium; and a fixing unit configured to thermally fix the toner image on the recording medium, said fixing unit comprising:

a fixing member having a plurality of internal heaters, and an outer peripheral surface configured to fix the toner on the recording medium; and a temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, having a state which generates no heat in response to power supplied from a first power supply even during an operation of the fixing unit, remaining second heaters, of the plurality of heaters, being capable of constantly generating heat in response to power supplied from a second power supply during the operation of the fixing unit, one of the second heaters closest to the temperature detecting position is the same distance from the temperature detecting position as or is closer to the temperature detecting position than a first heater which is closest to the temperature detecting position.

16. An image forming apparatus adapted to form an image on a recording medium by an electrophotography technique, comprising:

an image forming unit configured to form a toner image on a recording medium; and a fixing unit configured to thermally fix the toner image on the recording medium, said fixing unit comprising:

a fixing member having a plurality of internal heaters, and an outer peripheral surface configured to fix the toner on the recording medium; and a temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, receiving the power from a first power supply, remaining second heaters, of the plurality of heaters, receiving the power from a second power supply which is different from the first power supply, one of the second heaters closest to the temperature detecting position is the same distance from the temperature detecting position as or is closer to the temperature detecting position than a first heater which is closest to the temperature detecting position.

17. A fixing unit to thermally fix a toner on a recording medium, comprising:

a fixing member having a plurality of internal heaters, and an outer peripheral surface configured to fix the toner on the recording medium; and at least one temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, being capable of receiving the power from a battery, remaining second heaters, of the plurality of heaters, being capable of receiving the power from an external power supply, a temperature distribution of the surface temperature when the first heater is ON and a temperature distribution of the surface temperature when the first heater is OFF having a difference which is smaller than a predetermined value at the temperature detecting position.

18. The fixing unit as claimed in claim 17, wherein:

the fixing member comprises a fixing roller;

each of the plurality of heaters has a rod shape extending in a longitudinal direction of the fixing roller; and at least one of the second heaters is made up of a plurality of heater parts which are aligned in the longitudinal direction and are independently controllable.

19. The fixing unit as claimed in claim 18, wherein one second heater is made up of a center heater part located only in a central portion along the longitudinal direction of the fixing roller, and another second heater is made up of a pair of end heater parts located on both sides with respect to the central portion along the longitudinal direction of the fixing roller.

20. The fixing unit as claimed in claim 19, wherein the center heater part and the pair of end heater parts partially overlap in the longitudinal direction of the fixing roller.

21. The fixing unit as claimed in claim 19, wherein a first temperature sensor is provided with respect to the center heater part and a second temperature sensor is provided with respect to one of the pair of end heaters parts, and temperature detecting positions of the first and second temperature sensors are mutually different along a circumferential direction of the fixing roller.

22. The fixing unit as claimed in claim 18, wherein the controlled power supplied to each first heater is turned ON and OFF, and the controlled power supplied to each second heater is varied in a plurality of levels.

23. The fixing unit as claimed in claim 18, wherein the temperature sensor is only provided with respect to one of symmetrically arranged heater parts of each second heater.

24. The fixing unit as claimed in claim 18, wherein each heater part is configured to generate different amounts of heat in response to the same driving power at different positions along the longitudinal direction of the fixing roller.

25. A fixing unit to thermally fix a toner on a recording medium, comprising:

a fixing member having a plurality of internal heaters, and an outer peripheral surface configured to fix the toner on the recording medium; and at least one temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, being capable of receiving the power from a battery, remaining second heaters, of the plurality of heaters, being capable of receiving the power from an external power supply, a temperature distribution of the surface temperature when no first heater is provided and at least one of the second heaters is turned ON and a temperature distribution of the surface temperature when the first heater is provided and at least one of the second heaters is turned ON having a difference which is smaller than a predetermined value at the temperature detecting position.

26. The fixing unit as claimed in claim 25, wherein:

the fixing member comprises a fixing roller;

each of the plurality of heaters has a rod shape extending in a longitudinal direction of the fixing roller; and at least one of the second heaters is made up of a plurality of heater parts which are aligned in the longitudinal direction and are independently controllable.

27. The fixing unit as claimed in claim 26, wherein one second heater is made up of a center heater part located only in a central portion along the longitudinal direction of the fixing roller, and another second heater is made up of a pair of end heater parts located on both sides with respect to the central portion along the longitudinal direction of the fixing roller.

28. The fixing unit as claimed in claim 27, wherein the center heater part and the pair of end heater parts partially overlap in the longitudinal direction of the fixing roller.

29. The fixing unit as claimed in claim 27, wherein a first temperature sensor is provided with respect to the center heater part and a second temperature sensor is provided with respect to one of the pair of end heaters parts, and temperature detecting positions of the first and second temperature sensors are mutually different along a circumferential direction of the fixing roller.

30. The fixing unit as claimed in claim 26, wherein the controlled power supplied to each first heater is turned ON and OFF, and the controlled power supplied to each second heater is varied in a plurality of levels.

31. The fixing unit as claimed in claim 26, wherein the temperature sensor is only provided with respect to one of symmetrically arranged heater parts of each second heater.

32. The fixing unit as claimed in claim 26, wherein each heater part is configured to generate different amounts of heat in response to the same driving power at different positions along the longitudinal direction of the fixing roller.

33. An image forming apparatus adapted to form an image on a recording medium by an electrophotography technique, comprising:

an image forming unit configured to form a toner image on a recording medium; and a fixing unit configured to thermally fix the toner image on the recording medium, said fixing unit comprising:

a fixing member having a plurality of internal heaters, and an outer peripheral surface configured to fix the toner on the recording medium; and at least one temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, being capable of receiving the power from a battery, remaining second heaters, of the plurality of heaters, being capable of receiving the power from an external power supply, a temperature distribution of the surface temperature when the first heater is ON and a temperature distribution of the surface temperature when the first heater is OFF having a difference which is smaller than a predetermined value at the temperature detecting position.

34. An image forming apparatus adapted to form an image on a recording medium by an electrophotography technique, comprising:

an image forming unit configured to form a toner image on a recording medium; and a fixing unit configured to thermally fix the toner image on the recording medium, said fixing unit comprising:

a fixing member having a plurality of internal heaters, and an outer peripheral surface configured to fix the toner on the recording medium; and at least one temperature sensor configured to detect a surface temperature of the fixing member at a temperature detecting position, said plurality of heaters receiving power based on the surface temperature detected by the temperature sensor so that the surface temperature becomes a predetermined temperature, at least one first heater, of the plurality of heaters, being capable of receiving the power from a battery, remaining second heaters, of the plurality of heaters, being capable of receiving the power from an external power supply, a temperature distribution of the surface temperature when no first heater is provided and at least one of the second heaters is turned ON and a temperature distribution of the surface temperature when the first heater is provided and at least one of the second heaters is turned ON having a difference which is smaller than a predetermined value at the temperature detecting position.

35. A method of determining a temperature detecting position of a temperature sensor which is configured to detect a surface temperature of a fixing member having a plurality of internal heaters which receives power based on the surface temperature detected by the temperature sensor, at least one first heater, of the plurality of heaters, being capable of receiving the power from a battery, remaining second heaters, of the plurality of heaters, being capable of receiving the power from an external power supply, said method comprising the steps of:

obtaining a first temperature distribution of the surface temperature when the first heater and at least one second heater is ON;

obtaining a second temperature distribution of the surface temperature when the first heater is OFF and said at least one second heater is ON; and determining the temperature detecting position of the temperature sensor to a location where a difference between the first and second temperature distributions is smaller than a predetermined value.

36. A method of determining a temperature detecting position of a temperature sensor which is configured to detect a surface temperature of a fixing member having a plurality of internal heaters which receives power based on the surface temperature detected by the temperature sensor, at least one first heater, of the plurality of heaters, being capable of receiving the power from a battery, remaining second heaters, of the plurality of heaters, being capable of receiving the power from an external power supply, said method comprising the steps of:

obtaining a first temperature distribution of the surface temperature when no first heater is provided and at least one second heater is ON;

obtaining a second temperature distribution of the surface temperature when the first heater is provided and at least one second heater is ON; and determining the temperature detecting position of the temperature sensor to a location where a difference between the first and second temperature distributions is smaller than a predetermined value.

* * * * *